US009646624B2

(12) United States Patent
Disch et al.

(10) Patent No.: US 9,646,624 B2
(45) Date of Patent: May 9, 2017

(54) AUDIO ENCODER, AUDIO DECODER, METHOD FOR PROVIDING AN ENCODED AUDIO INFORMATION, METHOD FOR PROVIDING A DECODED AUDIO INFORMATION, COMPUTER PROGRAM AND ENCODED REPRESENTATION USING A SIGNAL-ADAPTIVE BANDWIDTH EXTENSION

(71) Applicant: Fraunhofer-Gesellschaft zur Foerderung der angewandten Forschung e.V., Munich (DE)

(72) Inventors: Sascha Disch, Fuerth (DE); Christian Helmrich, Erlangen (DE); Johannes Hilpert, Nuremberg (DE); Julien Robilliard, Nuremberg (DE); Konstantin Schmidt, Nuremberg (DE); Stephan Wilde, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/811,727

(22) Filed: Jul. 28, 2015

(65) Prior Publication Data

US 2015/0332702 A1 Nov. 19, 2015

Related U.S. Application Data

(63) Continuation of application No. PCT/EP2014/051641, filed on Jan. 28, 2014.
(Continued)

(51) Int. Cl.
*G10L 19/24* (2013.01)
*G10L 19/26* (2013.01)
(Continued)

(52) U.S. Cl.
CPC ..... *G10L 19/24* (2013.01); *G10L 19/20* (2013.01); *G10L 19/26* (2013.01); *G10L 19/265* (2013.01); *G10L 21/038* (2013.01)

(58) Field of Classification Search
CPC ..... G10L 19/24; G10L 21/038
See application file for complete search history.

(56) References Cited

U.S. PATENT DOCUMENTS 5,161,210 A 11/1992 Druyvesteyn et al.
7,835,904 B2 11/2010 Li et al.
(Continued)

FOREIGN PATENT DOCUMENTS

EP 2352147 A2 8/2011
JP 2012145895 A5 8/2012
(Continued)

OTHER PUBLICATIONS

Berisha, V et al., "A Scalable Bandwidth Extension Algorithm", 2007 IEEE International Conference on Acoustics, Speech, and Signal Processing Apr. 15-20, 2007 Honolulu, HI, USA IEEE, Piscataway, NJ, USA, XP031463921, ISBN 978-1-4244-0727-9, Apr. 15, 2007, pp. IV-601.
(Continued)

*Primary Examiner* — Douglas Godbold
(74) *Attorney, Agent, or Firm* — Perkins Coie LLP; Michael A. Glenn

(57) ABSTRACT

An audio encoder has a low frequency encoder which encodes a low frequency portion of the input audio information to obtain an encoded representation of the low frequency portion, and a bandwidth extension information provider which provides bandwidth extension information. The audio encoder is configured to selectively include bandwidth extension information into the encoded audio information in a signal-adaptive manner. An audio decoder
(Continued)

has a low frequency decoder which decodes an encoded representation of a low frequency portion to obtain a decoded representation of the low frequency portion, and a bandwidth extension which obtains a bandwidth extension signal using a blind bandwidth extension for portions of an audio content for which no bandwidth extension parameters are included in the encoded audio information, and which obtains the bandwidth extension signal using a parameter-guided bandwidth extension for portions of the audio content for which bandwidth extension parameters are included in the encoded audio information.

39 Claims, 8 Drawing Sheets

Related U.S. Application Data

(60) Provisional application No. 61/758,205, filed on Jan. 29, 2013.

(51) Int. Cl.
*G10L 19/20* (2013.01)
*G10L 21/038* (2013.01)

(56) References Cited

U.S. PATENT DOCUMENTS

| | | | | |
|---|---|---|---|---|
| 8,019,612 | B2 * | 9/2011 | Kjorling | G10L 19/0017 704/205 |
| 8,244,526 | B2 * | 8/2012 | Vos | G10L 19/0208 704/226 |
| 8,260,609 | B2 * | 9/2012 | Rajendran | G10L 21/038 704/208 |
| 8,484,036 | B2 * | 7/2013 | Vos | G10L 19/0208 704/219 |
| 8,600,737 | B2 * | 12/2013 | Yang | G10L 21/038 704/205 |
| 2007/0238415 | A1 | 10/2007 | Sinha et al. | |
| 2012/0010880 | A1 | 1/2012 | Nagel et al. | |
| 2013/0090934 | A1 | 4/2013 | Nagel et al. | |
| 2013/0275142 | A1 | 10/2013 | Chinen et al. | |

FOREIGN PATENT DOCUMENTS

| | | | |
|---|---|---|---|
| RU | 2411594 | C2 | 2/2011 |
| RU | 2455709 | C2 | 7/2012 |
| TW | 201044379 | A | 12/2010 |
| WO | 9857436 | A2 | 12/1998 |
| WO | 0079520 | A1 | 12/2000 |
| WO | 2010069885 | A1 | 6/2010 |
| WO | 2011000780 | A1 | 1/2011 |

OTHER PUBLICATIONS

Berisha, Visar et al., "Bandwidth Extension of Audio Based on Partial Loudness Criteria", 2006 IEEE Workshop on Multimedia Signal Processing: Victoria, BC, Canada, Oct. 3-6, 2006, IEEE Service Center, Piscataway, NJ, XP031011038, ISBN: 978-0-7803-9751-4, Oct. 6, 2006, pp. 146-149.

Bessette, B et al., "The Adaptive Multi-rate Wideband Speech Codec (AMR-WB)", IEEE Trans. on Speech and Audio Processing, vol. 10, No. 8, Nov. 2002, Nov 2002.

Geiser, B et al., "Bandwidth Extension for Hierarchical Speech and Audio Coding in ITU-T Rec. G.729.1", IEEE Transactions on Audio, Speech and Language Processing, IEEE Service Center, vol. 15, No. 8, Nov. 2007, pp. 2496-2509.

Iser, B et al., "Bandwidth Extension of Speech Signals", Springer Lecture Notes in Electrical Engineering, vol. 13, New York, 2008.

Jelinek, M et al., "Wideband Speech Coding Advances in VMR-WB Standard", IEEE Trans. on Audio, Speech, and Language Processing, vol. 15, No. 4, May 2007.

Katsir, I et al., "Speech Bandwidth Extension Based on Speech Phonetic Content and Speaker Vocal Tract Shape Estimation", in Proc. EUSIPCO 2011, Barcelona, Spain, Aug. 29-Sep. 2, 2011, pp. 461-465.

Larsen, E et al., "Audio Bandwidth Extension", Audio Bandwidth Extension: Application of Psychoacoustics, Signal Processing and Loudspeaker Design, Chichester [U.A.] : Wiley, XP002527508, ISBN: 978-0-470-85871-4 Retrieved from the Internet: URL:http://www.interscience.wiley.com [retrieved on May 11, 2009], Dec. 6, 2005.

Larsen, E et al., "Audio Bandwidth Extension: Application of Psychoacoustics, Signal Processing and Loudspeaker Design", Wiley, New York., 2004.

Makinen, J et al., "AMR-WB+: A New Audio Coding Standard for 3rd Generation Mobile Audio Services", in Proc. ICASSP 2005, Philadelphia, USA, Mar. 2005.

Miao, L et al., "G.711.1 Annex D and G.722 Annex B: New ITU-T Superband codecs", in Proc. ICASSP 2011, Prague, Czech Republic, May 2011.

Neuendorf, M et al., "MPEG Unified Speech and Audio Coding—The ISO/MPEG Standard for High-Efficiency Audio Coding of all Content Types", Audio Engineering Society Convention Paper 8654, Presented at the 132nd Convention, Apr. 26-29, 2012, pp. 1-22.

Pulakka, H et al., "Bandwidth Extension of Telephone Speech Using a Neural Network and a Filter Bank Implementation for Highband Mel Spectrum", IEEE Trans. on Audio, Speech, and Language Processing, vol. 19, No. 7, Sep. 2011, Sep. 2011.

Vaillancourt, T et al., "ITU-T EV-VBR: A Robust 8-32 kbit/s Scalable Coder for Error Prone Telecommunications Channels", in Proc. EUSIPCO 2008, Lausanne, Switzerland, Aug. 2008, 5 pages.

* cited by examiner

AUDIO ENCODER, AUDIO DECODER, METHOD FOR PROVIDING AN ENCODED AUDIO INFORMATION, METHOD FOR PROVIDING A DECODED AUDIO INFORMATION, COMPUTER PROGRAM AND ENCODED REPRESENTATION USING A SIGNAL-ADAPTIVE BANDWIDTH EXTENSION

CROSS-REFERENCE TO RELATED APPLICATIONS

This application is a continuation of copending International Application No. PCT/EP2014/051641, filed Jan. 28, 2014, which is incorporated herein by reference in its entirety, and additionally claims priority from U.S. Provisional Application No. 61/758,205, filed Jan. 29, 2013, which is also incorporated herein by reference in its entirety.

TECHNICAL FIELD

Embodiments according to the invention are related to an audio encoder for providing an encoded audio information on the basis of an input audio information.

Further embodiments according to the invention are related to an audio decoder for providing a decoded audio information on the basis of an encoded audio information.

Further embodiments according to the invention are related to a method for providing an encoded audio information on the basis of an input audio information.

Further embodiments according to the invention are related to a method for providing a decoded audio information on the basis of an encoded audio information.

Further embodiments according to the invention are related to a computer program for performing one of said methods.

Further embodiments according to the invention are related to an encoded audio representation representing an audio information.

Some embodiments according to the invention are related to a generic audio bandwidth extension with signal-adaptive side information rate for very-low-bitrate audio coding.

BACKGROUND OF THE INVENTION

In the recent years, an increasing demand for an encoding and decoding of audio content has developed. While the available bitrates and storage capacities for transmission and storage of encoded audio contents have substantially increased, there is still a demand for a bitrate efficient encoding, transmission, storage and decoding of audio contents at reasonable quality, especially of speech signals in communication scenarios.

Contemporary speech coding systems are capable of encoding wideband (WB) digital audio content, that is, signals with frequencies of up to 7-8 kHz, at bitrates as low as 6 kbps. The most widely discussed examples are the ITU-T recommendations G.722.2 (cf., for example, reference [1]) as well as the more recently developed G.718 (cf., for example, references [4] and [10]) and MPEG unified speech and audio codec xHE-AAC (cf., for example, reference [8]). Both G.722.2, also known as AMR-WB, and G.718 employ bandwidth extension (BWE) techniques between 6.4 and 7 kHz to allow the underlying ACELP core-coder to "focus" on the perceptually more relevant lower frequencies (particularly the ones at which the human auditory system is phase-sensitive), and thereby achieve sufficient quality, especially at very low bitrates. In xHE-AAC, enhanced spectral band replication (eSBR) is used for bandwidth extension (BWE). The bandwidth extension process can generally be divided into two conceptual approaches:

- "blind" or "artificial" BWE, in which high-frequency (HF) components are reconstructed from the decoded low-frequency (LF) core-coder signal alone, i.e. without necessitating side-information transmitted from the encoder. This scheme is used by AMR-WB and G.718 at 16 kbps and below, as well as some backward-compatible bandwidth extension post-processing systems operating on traditional narrowband telephonic speech (cf., for example, references [5] and [9]).
- "guided" BWE, which differs from blind bandwidth extension in that some of the parameters used for high-frequency (HF) content reconstruction are transmitted to the decoder as side information instead of being estimated from the decoded core signal. AMR-WB, G.718, xHE-AAC as well as some other codecs (cf., for example, references [2], [7] and [11]) use this approach, but not at very low bitrates.

However, it has been found that it is difficult to provide appropriate bandwidth extension at low bitrates which provides for a sufficiently good quality in the reconstruction of the audio content.

Thus, there is a need for a bandwidth extension concept which brings along an improved tradeoff between bitrate and audio quality.

SUMMARY

According to an embodiment, an audio encoder for providing an encoded audio information on the basis of an input audio information may have: a low frequency encoder configured to encode a low frequency portion of the input audio information to obtain an encoded representation of the low frequency portion; and a bandwidth extension information provider configured to provide bandwidth extension information on the basis of the input audio information; wherein the audio encoder is configured to selectively include bandwidth extension information into the encoded audio information in a signal-adaptive manner; wherein the audio encoder has a detector configured to identify portions of the input audio information for which bandwidth extension parameters cannot be estimated on the basis of the low frequency portion with a sufficient or desired accuracy; and wherein the audio encoder is configured to selectively include bandwidth extension information into the encoded audio information for portions of the input audio information identified by the detector.

According to another embodiment, an audio decoder for providing a decoded audio information on the basis of an encoded audio information may have: a low frequency decoder configured to decode an encoded representation of a low frequency portion to obtain a decoded representation of the low frequency portion; and a bandwidth extension configured to obtain a bandwidth extension signal using a blind bandwidth extension for portions of an audio content for which no bandwidth extension parameters are included in the encoded audio information, and to obtain the bandwidth extension signal using a parameter-guided bandwidth extension for portions of the audio content for which bandwidth extension parameters are included in the encoded audio information; wherein the audio decoder is configured to decide whether to use a blind bandwidth extension or a parameter-guided bandwidth extension on the basis of the encoded representation of the low frequency portion without evaluating a bandwidth extension mode signaling flag.

According to still another embodiment, a method for providing an encoded audio information on the basis of an input audio information may have the steps of: encoding a low frequency portion of the input audio information to obtain an encoded representation of the low frequency portion; and providing bandwidth extension information on the basis of the input audio information; wherein bandwidth extension information is selectively included into the encoded audio information in a signal-adaptive manner; wherein the method has identifying portions of the input audio information for which bandwidth extension parameters cannot be estimated on the basis of the low frequency portion with a sufficient or desired accuracy; and wherein the method has selectively including bandwidth extension information into the encoded audio information for identified portions of the input audio information.

According to another embodiment, a method for providing a decoded audio information on the basis of an encoded audio information may have the steps of: decoding an encoded representation of a low frequency portion to obtain a decoded representation of the low frequency portion; and obtaining a bandwidth extension signal using a blind bandwidth extension for portions of an audio content for which no bandwidth extension parameters are included in the encoded audio information, and obtaining the bandwidth extension signal using a parameter-guided bandwidth extension for portions of the audio content for which bandwidth extension parameters are included in the encoded audio information; wherein the method has deciding whether to use a blind bandwidth extension or a parameter-guided bandwidth extension on the basis of the encoded representation of the low frequency portion without evaluating a bandwidth extension mode signaling flag.

Another embodiment may have a computer program for performing the above methods when the computer program runs on a computer.

According to another embodiment, an audio encoder for providing an encoded audio information on the basis of an input audio information may have: a low frequency encoder configured to encode a low frequency portion of the input audio information to obtain an encoded representation of the low frequency portion; and a bandwidth extension information provider configured to provide bandwidth extension information on the basis of the input audio information; wherein the audio encoder is configured to selectively include bandwidth extension information into the encoded audio information in a signal-adaptive manner; wherein the audio encoder has a detector configured to identify portions of the input audio information in dependence on whether a difference between a spectral envelope of a low frequency portion and a spectral envelope of a high frequency portion is larger than or equal to a predetermined difference measure; and wherein the audio encoder is configured to selectively include bandwidth extension information into the encoded audio information for portions of the input audio information identified by the detector.

According to another embodiment, an audio encoder for providing an encoded audio information on the basis of an input audio information may have: a low frequency encoder configured to encode a low frequency portion of the input audio information to obtain an encoded representation of the low frequency portion; and a bandwidth extension information provider configured to provide bandwidth extension information on the basis of the input audio information; wherein the audio encoder is configured to selectively include bandwidth extension information into the encoded audio information in a signal-adaptive manner; wherein the audio encoder has a detector configured to determine a spectral tilt of portions of the input audio information, and to identify portions of the input audio information in dependence on whether the determined spectral tilt is larger than or equal to a fixed or variable tilt threshold value; and wherein the audio encoder is configured to selectively include bandwidth extension information into the encoded audio information for portions of the input audio information identified by the detector.

According to another embodiment, an audio decoder for providing a decoded audio information on the basis of an encoded audio information may have: a low frequency decoder configured to decode an encoded representation of a low frequency portion to obtain a decoded representation of the low frequency portion; and a bandwidth extension configured to obtain a bandwidth extension signal using a blind bandwidth extension for portions of an audio content for which no bandwidth extension parameters are included in the encoded audio information, and to obtain the bandwidth extension signal using a parameter-guided bandwidth extension for portions of the audio content for which bandwidth extension parameters are included in the encoded audio information; wherein the bandwidth extension is configured to perform a smoothing of energies of the bandwidth extension signal when switching from blind bandwidth extension to parameter-guided bandwidth extension and/or when switching from parameter-guided bandwidth extension to blind bandwidth extension; wherein the bandwidth extension is configured to dampen a high frequency portion of the bandwidth extension signal for a portion of the audio content to which a parameter guided bandwidth extension is applied following a portion of the audio content to which a blind bandwidth extension is applied; and wherein the bandwidth extension is configured to reduce a damping or to increase a level for a high frequency portion of the bandwidth extension signal for a portion of the audio content to which a blind bandwidth extension is applied following a portion of the audio content to which a parameter guided bandwidth extension is applied.

According to another embodiment, a method for providing an encoded audio information on the basis of an input audio information may have the steps of: encoding a low frequency portion of the input audio information to obtain an encoded representation of the low frequency portion; and providing bandwidth extension information on the basis of the input audio information; wherein bandwidth extension information is selectively included into the encoded audio information in a signal-adaptive manner; wherein the method has identifying portions of the input audio information in dependence on whether a difference between a spectral envelope of a low frequency portion and a spectral envelope of a high frequency portion is larger than or equal to a predetermined difference measure; and wherein the method has selectively including bandwidth extension information into the encoded audio information for identified portions of the input audio information.

According to another embodiment, a method for providing an encoded audio information on the basis of an input audio information may have the steps of: encoding a low frequency portion of the input audio information to obtain an encoded representation of the low frequency portion; and providing bandwidth extension information on the basis of the input audio information; wherein bandwidth extension information is selectively included into the encoded audio information in a signal-adaptive manner; wherein the method has determining a spectral tilt of portions of the input audio information, and identifying portions of the input audio information in dependence on whether the determined spectral tilt is larger than or equal to a fixed or variable tilt threshold value; and wherein the method has selectively including bandwidth extension information into the encoded audio information for identified portions of the input audio information.

According to another embodiment, a method for providing a decoded audio information on the basis of an encoded audio information may have the steps of: decoding an encoded representation of a low frequency portion to obtain a decoded representation of the low frequency portion; and obtaining a bandwidth extension signal using a blind bandwidth extension for portions of an audio content for which no bandwidth extension parameters are included in the encoded audio information, and obtaining the bandwidth extension signal using a parameter-guided bandwidth extension for portions of the audio content for which bandwidth extension parameters are included in the encoded audio information; wherein the method has performing a smoothing of energies of the bandwidth extension signal when switching from blind bandwidth extension to parameter-guided bandwidth extension and/or when switching from parameter-guided bandwidth extension to blind bandwidth extension; wherein the method has dampening a high frequency portion of the bandwidth extension signal for a portion of the audio content to which a parameter guided bandwidth extension is applied following a portion of the audio content to which a blind bandwidth extension is applied; and wherein the method has reducing a damping or increasing a level for a high frequency portion of the bandwidth extension signal for a portion of the audio content to which a blind bandwidth extension is applied following a portion of the audio content to which a parameter guided bandwidth extension is applied.

Another embodiment may have a computer program for performing the above methods when the computer program runs on a computer.

An embodiment according to the invention creates an audio encoder for providing an encoded audio information on the basis of an input audio information. The audio encoder comprises a low frequency encoder configured to encode a low frequency portion of the input audio information to obtain an encoded representation of the low frequency portion. The audio encoder also comprises a bandwidth extension information provider configured to provide bandwidth extension information on the basis of the input audio information. The audio encoder is configured to selectively include bandwidth extension information into the encoded audio information in a signal-adaptive manner.

This embodiment according to the invention is based on the finding that, for some types of audio content, and even for some portions of a contiguous piece of audio content, a good quality bandwidth extension can be achieved on the basis of the encoded representation of the low frequency portion without any bandwidth extension side information, or with only a small amount of bandwidth extension side information (for example, a small number of bandwidth extension parameters, which are included into the encoded audio information). However, the concept is also based on the finding that, for other types of audio content, and even for other portions of a contiguous piece of audio content, it may be necessitated (or at least very desirable) to include a bandwidth extension side information (for example, dedicated bandwidth extension parameters), or an increased amount of bandwidth extension side information (for example, when compared to the previously mentioned case) into the encoded audio information, because otherwise a decoder-sided bandwidth extension does not provide a satisfactory audio quality.

By selectively including bandwidth extension information into the encoded audio information (for example, by selectively varying an amount of bandwidth extension information or bandwidth extension parameters included into the encoded audio information, or by selectively switching between an inclusion of bandwidth extension information into the encoded audio information and an omission of said inclusion of bandwidth extension information into the encoded audio information), it can be avoided that "unnecessary" bandwidth extension information consumes precious bitrate for the case that a decoder-sided bandwidth extension does not really necessitate the bandwidth extension information, and it can nevertheless be ensured that bandwidth extension information (or an increased amount of bandwidth extension information) is included into the encoded audio information if the bandwidth extension information is actually necessitated for a decoder-sided bandwidth extension, i.e. for a decoder-sided reconstruction of the audio content.

Thus, by selectively including bandwidth extension information into the encoded audio information in a signal-adaptive manner, i.e., when the bandwidth extension information is actually needed for reaching a sufficiently good quality of a decoded audio signal representation, the average bitrate can be reduced while still maintaining the possibility to obtain a good audio quality.

In other words, the audio encoder may, for example, switch between a provision of a bandwidth extension information, which allows for a parameter-guided bandwidth extension at the side of an audio decoder, and an omission of the provision of the bandwidth extension information, which necessitates the usage of a blind bandwidth extension at the side of an audio decoder.

Accordingly, a particularly good tradeoff between bitrate and audio quality can be obtained using the above described concept.

In an embodiment, the audio encoder comprises a detector configured to identify portions of the input audio information which cannot be decoded with a sufficient or desired quality (for example, in terms of a predetermined quality measure) on the basis of the encoded representation of the low-frequency portion, and using a blind bandwidth extension. In this case, the audio encoder is configured to selectively include bandwidth extension information into the encoded audio information for portions of the input audio information identified by the detector. By determining, or estimating (for example, on the basis of features of the input audio information, or on the basis of a partial or a complete reconstruction of the audio information on the side of the audio encoder), which portions of the input audio information cannot be decoded with a sufficient (or desired) quality on the basis of the encoded representation of the low-frequency portion, and using a blind bandwidth extension, a meaningful criterion is obtained to decide whether to include bandwidth extension information into the encoded audio information or not for portions (for example, frames) of the input audio information (or equivalently, for frames or portions of the encoded audio information). In other words, the above mentioned criterion, which is evaluated by the detector, allows for a good tradeoff between the hearing impression, which can be achieved by decoding the encoded audio information, and the bitrate of the encoded audio information.

In an embodiment, the audio encoder comprises a detector configured to identify portions of the input audio information for which bandwidth extension parameters cannot be estimated on the basis of the low-frequency portion with sufficient or desired accuracy. In this case, the audio encoder is configured to selectively include bandwidth extension information into the encoded audio information for portions of the input audio information identified by the detector. This embodiment according to the invention is based on the finding that a determination as to whether bandwidth extension parameters can be estimated on the basis of a low-frequency portion with sufficient or desired accuracy or not constitutes a criterion which can be evaluated with moderate computational effort, and which nevertheless constitutes a good criterion for deciding whether to include bandwidth extension information into the encoded audio information or not.

In an embodiment, the audio encoder comprises a detector configured to identify portions of the input audio information in dependence on whether the portions are temporally stationary portions and in dependence on whether the portions have a low-pass character. Moreover, the audio encoder is configured to selectively omit an inclusion of bandwidth extension information into the encoded audio information for portions of the input audio information identified by the detector as temporally stationary portions having a low-pass character.

This embodiment according to the invention is based on the finding that it is typically not necessary to include bandwidth extension information into the encoded audio information for portions of the input audio information which are temporally stationary and comprise a low-pass character, since a blind bandwidth extension (which does not rely on bandwidth extension information or parameters from the bitstream) typically allows for sufficiently good reconstruction of such signal portions. Accordingly, there is a criterion which can be evaluated in a computationally efficient manner, and which nevertheless enables good results (in terms of a tradeoff between bitrate and audio quality).

In an embodiment, the detector is configured to identify portions of the input audio information in dependence on whether the portions comprise voiced speech, and/or in dependence on whether the portions comprise environmental (e.g. car) noise, and/or in dependence on whether the portions comprise music without percussive instrumentation. It has been found that such portions, which comprise voiced speech, or which comprise environmental noise, or which comprise music without percussive instrumentation, can typically be reconstructed using a blind bandwidth extension with sufficient audio quality, such that it is recommendable to omit the inclusion of bandwidth extension information into the encoded audio information for such portions.

In an embodiment, the audio encoder comprises a detector configured to identify portions of the input audio information in dependence on whether a difference between a spectral envelope of a low-frequency portion and a spectral envelope of a high-frequency portion is larger than or equal to a predetermined difference measure. In this case, the audio encoder is configured to selectively include bandwidth extension information into the encoded audio information for portions of the input audio information identified by the detector.

It has been found that portions of the input audio information, which comprise a large difference between a spectral envelope of a low-frequency portion and a spectral envelope of a high-frequency portion, can typically not be well-reconstructed using a blind bandwidth extension, since a blind bandwidth extension often provides similar spectral envelopes in the high-frequency portion (i.e., in the bandwidth extension signal) when compared to the respective low-frequency portion. Accordingly, it has been found that an assessment of the difference between the spectral envelope of the low-frequency portion and the spectral envelope of the high-frequency portion constitutes a good criterion for deciding whether to include bandwidth extension information into the encoded audio information or not.

In an embodiment, the detector is configured to identify portions of the input audio information in dependence on whether the portions comprise unvoiced speech, and/or in dependence on whether the portions comprise percussive sounds. It has been found that portions comprising unvoiced speech and portions comprising percussive sounds typically comprise spectra in which the spectral envelope of the low-frequency portion differs substantially from the spectral envelope of the high-frequency portion. Accordingly, detection of unvoiced speech and/or of percussive sounds has been found to be a good criterion for deciding whether to include bandwidth extension information into the encoded audio information or not.

In an embodiment, the audio encoder comprises a detector configured to determine a spectral tilt of portions of the input audio information, and to identify portions of the input audio information in dependence on whether the determined spectral tilt is larger than or equal to a fixed or variable tilt threshold value. In this case, the audio encoder is configured to selectively include bandwidth extension information into the encoded audio information for portions of the input audio information identified by the detector. It has been found that a spectral tilt can be derived with moderate computational effort and still provides a good criterion for the decision whether to include the bandwidth extension information into the encoded audio information or not. For example, if the spectral tilt reaches or exceeds a tilt threshold value, it can be concluded that the spectrum has a high-pass character and cannot be well-reconstructed by blind bandwidth extension. In particular, blind bandwidth extension typically cannot reconstruct spectra comprising a positive tilt (wherein a high-frequency portion is emphasized over a low-frequency portion) with good accuracy. Moreover, since a high-frequency portion is of particular perceptual relevance in the case of a positive spectral tilt, it is recommendable in such cases to include the bandwidth extension information into the encoded audio representation.

In an embodiment, the detector is further configured to determine a zero crossing rate of portions of the input audio information, and to identify portions of the input audio information also in dependence on whether the determined zero crossing rate is larger than or equal to a fixed or variable zero crossing rate threshold value. It has been found that the zero crossing rate is also a good criterion to detect portions of the input audio information which cannot be well-reconstructed using a blind bandwidth extension, such that it makes sense (in terms of achieving a good tradeoff between bitrate and audio quality) to include the bandwidth extension information into the encoded audio information.

In an embodiment, the detector is configured to apply a hysteresis for identifying signal portions of the input audio information, to reduce a number of transitions between identified signal portions (for which bandwidth extension information is included into the encoded audio representation) and not-identified signal portions (for which bandwidth extension information is not included into the encoded audio representation). It has been found that it is advantageous to avoid an excessive switching between an inclusion of bandwidth extension information into the encoded audio information and an omission of the inclusion of the bandwidth extension information into the encoded audio representation, since such transitions may bring along some artifacts, in particular if the number of transitions is very high. Accordingly, using a hysteresis, which may, for example, be applied to the tilt threshold value (which is then a variable tilt threshold value) or to the zero crossing rate threshold value (which is then a variable zero crossing rate threshold value), this objective can be achieved.

In an embodiment, the audio encoder is configured to selectively include parameters representing a spectral envelope of a high-frequency portion of the input audio information into the encoded audio information in a signal-adaptive manner as the bandwidth extension information. This embodiment is based on the idea that parameters representing the spectral envelope of the high-frequency portion are particularly important in a parameter-guided bandwidth extension, such that the inclusion of said parameters representing the spectral envelope of the high-frequency portion of the input audio information allows to achieve a good quality bandwidth extension without causing a high bitrate.

In an embodiment, the low-frequency encoder is configured to encode a low-frequency portion of the input audio information comprising frequencies up to a maximum frequency which lies in a range between 6 kHz and 7 kHz. Moreover, the audio encoder is configured to selectively include into the encoded audio representation between three and five parameters describing intensities of high frequency signal portions or sub-portions (for example, signal portions having frequencies above approximately 6 to 7 kHz) having bandwidths between 300 Hz and 500 Hz. It has been found that such a concept results in a good audio quality without substantially compromising a bitrate effort.

In an embodiment, the audio encoder is configured to selectively include into the encoded audio representation 3-5 scalar quantized parameters describing intensities of four high-frequency signal portions (or sub-portions), the high-frequency signal portions (or sub-portions) covering frequency ranges above the low-frequency portion. It has been found that usage of 3-5 scalar quantized parameters describing intensities of four high-frequency signal portions is typically sufficient to achieve a parameter-guided bandwidth extension that exceeds a relatively low audio quality obtainable by a blind bandwidth extension on the same signal portion. Accordingly, there are no big quality differences between reconstructed audio signal portions, irrespective of whether the reconstructed audio signal portions are reconstructed using a blind bandwidth extension or a guided bandwidth extension. Thus, the above-mentioned concept is well-adapted to the concept which allows for a switching between a blind bandwidth extension and a parameter-guided bandwidth extension.

In an embodiment, the audio encoder is configured to selectively include into the encoded audio representation a plurality of parameters describing a relationship between energies of spectrally adjacent frequency portions, wherein one of the parameters describes a ratio between an energy of a first bandwidth extension high-frequency portion and a low-frequency portion, and wherein other of the parameters describe ratios between energies of (pairs of) other bandwidth extension high-frequency portions. It has been found that such a concept describing ratios (or differences) between energies (or, equivalently, intensities) of different (advantageously adjacent) frequency portions allows for an efficient encoding of the bandwidth extension information. It has also been found that such parameters describing a relationship between energies of spectrally adjacent frequency portions can typically be quantized with only a small number of bits without substantially compromising an audio quality achievable by a bandwidth extension.

Another embodiment according to the invention creates an audio decoder for providing a decoded audio information on the basis of an encoded audio information. The audio decoder comprises a low-frequency decoder configured to decode an encoded representation of a low-frequency portion (of an audio content), to obtain a decoded representation of the low-frequency portion. The audio decoder also comprises a bandwidth extension configured to obtain a bandwidth extension signal using a blind bandwidth extension for portions of an audio content for which no bandwidth extension parameters are included in the encoded audio information, and to obtain the bandwidth extension signal using a parameter-guided bandwidth extension for portions of the audio content for which bandwidth extension parameters are included in the encoded audio information.

This audio encoder is based on the idea that a good tradeoff between audio quality and bitrate is achievable if it is possible to switch between a blind bandwidth extension and a parameter-guided bandwidth extension even within a contiguous piece of audio content, since it has been found that many typical pieces of audio content comprise both sections for which a good audio quality can be obtained using a blind bandwidth extension and sections for which a parameter-guided bandwidth extension is necessitated in order to achieve sufficient audio quality. Moreover, it should be evident that the same considerations explained above with respect to the audio encoder also apply to the audio decoder.

In an embodiment, the audio decoder is configured to decide whether to obtain the bandwidth extension signal using a blind bandwidth extension or using a parameter-guided bandwidth extension on a frame-by-frame basis. It has been found that such a fine-grained (frame-by-frame) switching between a blind bandwidth extension and a parameter-guided bandwidth extension helps to keep the bitrate reasonably low, even if there are regularly some frames in which a parameter-guided bandwidth extension is necessitated to avoid an excessive degradation of the audio content.

In an embodiment, the audio decoder is configured to switch between a usage of a blind bandwidth extension and a parameter-guided bandwidth extension within a contiguous piece of audio content. This embodiment is based on the finding that even a single (contiguous) piece of audio content often comprises passages (or portions, or frames) of different kinds, some of which should be encoded (and, consequently, decoded) using a parameter-guided bandwidth extension, while other passages or frames can be decoded using a blind bandwidth extension without a substantial degradation of the audio quality.

In an embodiment, the audio decoder is configured to evaluate flags included in the encoded audio information for different portions (for example, frames) of the audio content, to decide whether to use a blind bandwidth extension or a parameter-guided bandwidth extension (for example, for the frame to which the flag is associated). Accordingly, the decision whether a blind bandwidth extension or a parameter-guided bandwidth extension should be used, is kept simple, and the audio decoder does not need to have substantial intelligence to decide whether to use a blind bandwidth extension or a parameter-guided bandwidth extension.

However, in another embodiment, the audio decoder is configured to decide whether to use a blind bandwidth extension or a parameter-guided bandwidth extension on the basis of the encoded representation of the low-frequency portion without evaluating a bandwidth extension mode signaling flag. Thus, by providing intelligence in the audio decoder, a bandwidth extension mode signaling flag can be omitted, which reduces the bitrate.

In an embodiment, the audio decoder is configured to decide whether to use a blind bandwidth extension or a parameter-guided bandwidth extension on the basis of one or more features of the decoded representation of the low-frequency portion (of the audio content). It has been found that features of the decoded representation of the low-frequency portion constitute quantities which can be used, with good accuracy, to decide whether to use a blind bandwidth extension or a parameter-guided bandwidth extension. This is particularly true if the same features are used at the side of an audio encoder. Accordingly, it is no longer necessary to evaluate a bandwidth extension mode signaling flag, which in turn allows for a reduction of the bitrate, since it is not necessary to include a bandwidth extension mode signaling flag into the encoded audio representation at the side of an audio encoder.

In an embodiment, the audio decoder is configured to decide whether to use a blind bandwidth extension or a parameter-guided bandwidth extension on the basis of quantized linear prediction coefficients and/or time domain statistics of the decoded representation of the low-frequency portion (of the audio content). It has been found that quantized linear prediction coefficients are easily obtainable at the side of an audio decoder, and by allowing to derive a spectral tilt, can therefore serve as a good indication whether to use a blind bandwidth extension or a parameter-guided bandwidth extension. Moreover, the quantized linear prediction coefficients are also easily accessible at the side of an audio encoder, such that it is easily possible to coordinate a switching between a blind bandwidth extension and a parameter-guided bandwidth extension at the side of an audio encoder and at the side of an audio decoder. Similarly, time domain statistics of the decoded representation of the low-frequency portion, such as a zero-crossing rate, have been found to be a reliable quantity for deciding whether to use a blind bandwidth extension or a parameter-guided bandwidth extension at the side of an audio decoder.

In an embodiment, the bandwidth extension is configured to obtain the bandwidth extension signal using one or more features of the decoded representation of the low-frequency portion and/or using one or more parameters of the low-frequency decoder for temporal portions of the input audio information (or content) for which no bandwidth extension parameters are included in the encoded audio information. It has been found that such a blind bandwidth extension results in a good audio quality.

In an embodiment, the bandwidth extension is configured to obtain the bandwidth extension signal using a spectral centroid information and/or using an energy information and/or using a (spectral) tilt information and/or using coded filter coefficients for temporal portions of the input audio information (or content) for which no bandwidth extension parameters are included in the encoded audio information. It has been found that usage of these quantities yields an efficient way to obtain a good quality bandwidth extension.

In an embodiment, the bandwidth extension is configured to obtain the bandwidth extension signal using bitstream parameters describing a spectral envelope of a high-frequency portion for temporal portions of the audio content for which bandwidth extension parameters are included in the encoded audio information. It has been found that usage of bitstream parameters describing a spectral envelope of the high-frequency portion allows for a bitrate-efficient parameter-guided bandwidth extension with good quality, wherein the bitstream parameters describing the spectral envelope typically do not require a high bitrate but can be encoded with only a comparatively small number of bits per audio frame. Consequently, even the switching towards the parameter-guided bandwidth extension does not result in a substantial increase of the bitrate.

In an embodiment, the bandwidth extension is configured to evaluate between three and five bitstream parameters describing intensities of high-frequency signal portions having bandwidths between 300 Hz and 500 Hz in order to obtain the bandwidth extension signal. It has been found that a comparatively small number of bitstream parameters is sufficient to obtain a bandwidth extension over a perceptually important range, such that a good audio quality can be obtained with a small increase in bitrate.

In an embodiment, the between three and five bitstream parameters describing intensities of high-frequency signal portions having bandwidths between 300 Hz and 500 Hz are scalar quantized with 2 or 3 bits resolution such that there are between 6 and 15 bits of bandwidth extension spectral shaping parameters per audio frame. It has been found that such a choice allows for a very high bitrate efficiency of the parameter-guided bandwidth extension, while a bandwidth extension quality is typically comparable with the bandwidth extension quality obtainable using blind bandwidth extension for "uncritical" portions of the audio content, in which the blind bandwidth extension offers good results. Accordingly, there is a balanced quality both in the case that blind bandwidth extension is applied and in the case that parameter-guided bandwidth extension is applied.

In an embodiment, the bandwidth extension is configured to perform a smoothing of energies of the bandwidth extension signal when switching from blind bandwidth extension to parameter-guided bandwidth extension and/or when switching from parameter-guided bandwidth extension to blind bandwidth extension. Accordingly, clicks or "blocking artifacts" which might be caused by the different properties of the blind bandwidth extension and the parameter-guided bandwidth extension can be avoided.

In an embodiment, the bandwidth extension is configured to dampen a high-frequency portion of the bandwidth extension signal for a portion of the audio content to which a parameter-guided bandwidth extension is applied following a portion of the audio content to which a blind bandwidth extension is applied. Moreover, the bandwidth extension is configured to reduce a damping for a high-frequency portion of the bandwidth extension signal for a portion of the audio content to which a blind bandwidth extension is applied following a portion of the audio content to which a parameter-guided bandwidth extension is applied. Accordingly, the effect that the blind bandwidth extension typically shows a low-pass characteristic, while this is not necessarily the case for the parameter-guided bandwidth extension, can be compensated to some degree. Accordingly, artifacts at transitions between portions of the audio content decoded using a blind bandwidth extension and using a parameter-guided bandwidth extension are reduced.

Another embodiment according to the invention creates a method for providing an encoded audio information on the basis of an input audio information. The method comprises encoding a low-frequency portion of the input audio information to obtain an encoded representation of the low-frequency portion. The method also comprises providing bandwidth extension information on the basis of the input audio information. The bandwidth extension information is selectively included into the encoded audio information in a signal-adaptive manner. This method is based on the same considerations as the above-described audio encoder.

Another embodiment according to the invention creates a method for providing a decoded audio information on the basis of an encoded audio information. The method comprises decoding an encoded representation of a low-frequency portion to obtain a decoded representation of the low-frequency portion. The method further comprises obtaining a bandwidth extension signal using a blind bandwidth extension for portions of an audio content for which no bandwidth extension parameters are included in the encoded audio information. The method further comprises obtaining the bandwidth extension signal using a parameter-guided bandwidth extension for portions of the audio content for which bandwidth extension parameters are included in the encoded audio information. This method is based on the same considerations as the above-described audio decoder.

Another embodiment according to the invention creates a computer program for performing one of the above-mentioned methods when the computer program runs on a computer.

Another embodiment according to the invention creates an encoded audio representation representing an audio information. The encoded audio representation comprises an encoded representation of a low-frequency portion of an audio information and a bandwidth extension information. The bandwidth extension information is included in the encoded audio representation in a signal-adaptive manner for some but not for all portions of the audio information. This encoded audio information is provided by the audio encoder described above, and can be evaluated by the audio decoder described above.

BRIEF DESCRIPTION OF THE DRAWINGS

Embodiments according to the present invention will subsequently be described taking reference to the enclosed figures, in which.

DETAILED DESCRIPTION OF THE INVENTION

1. Audio Encoder According to FIG. 1

Figure 1:
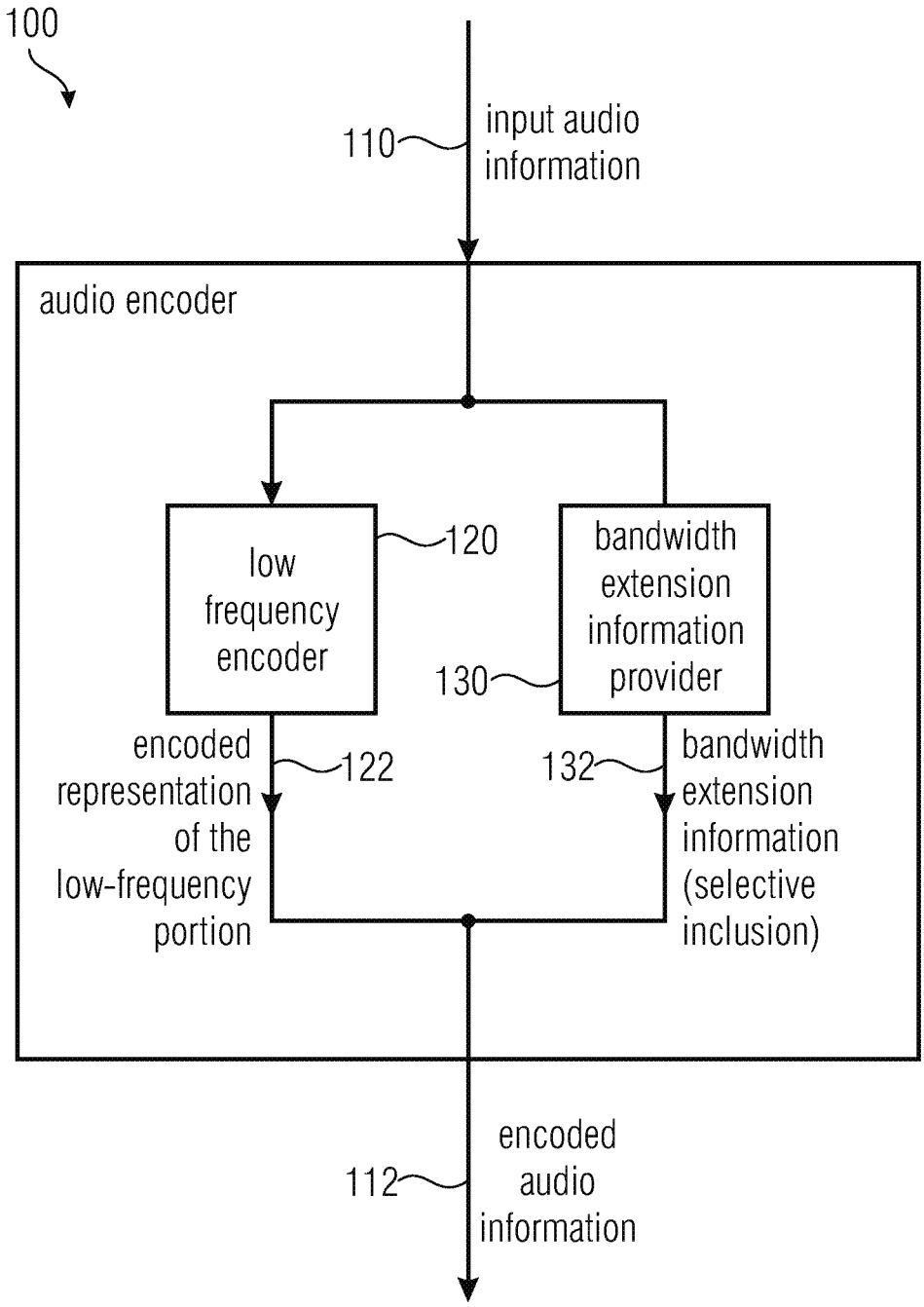
FIG. 1 shows a block schematic diagram of an audio encoder, according to an embodiment of the present invention.

FIG. 1 shows a block schematic diagram of an audio encoder, according to an embodiment of the present invention.

The audio encoder 100 according to FIG. 1 receives an input audio information 110 and provides, on the basis thereof, an encoded audio information 112. The audio encoder 100 comprises a low frequency encoder 120, which is configured to encode a low frequency portion of the input audio information 110, to obtain an encoded representation 122 of the low-frequency portion. The audio encoder 100 also comprises a bandwidth extension information provider 130 configured to provide bandwidth extension information 132 on the basis of the input audio information 110. The audio encoder 100 is configured to selectively include bandwidth extension information 132 into the encoded audio information 112 in a signal-adaptive manner.

Regarding the functionality of the audio encoder 100, it can be said that the audio encoder 100 provides for a bitrate efficient encoding of the input audio information 110. A low-frequency portion, for example in a frequency range up to approximately 6 or 7 kHz, is encoded using the low-frequency encoder 120, wherein any of the known audio encoding concepts can be used. For example, the low-frequency encoder 120 may be a "general audio" encoder (like, for example, an AAC audio encoder) or a speech-type audio encoder (like, for example, a linear-prediction-based audio encoder, a CELP audio encoder, an ACELP audio encoder, or the like). Accordingly, the low-frequency portion of the input audio information is encoded using any of the conventional concepts. However, the bitrate of the encoded representation 122 of the low-frequency portion is kept reasonably small, since only frequency components up to approximately 6 to 7 kHz are encoded. Moreover, the audio encoder 100 is capable of providing a bandwidth extension information, for example, in the form of bandwidth extension parameters describing a high-frequency portion of the input audio information 110, like, for example, a frequency region comprising higher frequencies than the frequency region encoded by the low-frequency encoder 120. Thus, the bandwidth extension information provider 130 is capable of providing a side information of the encoded audio information 112, which can control a bandwidth extension performed at the side of an audio decoder not shown in FIG. 1. The bandwidth extension information (or bandwidth extension side information) may, for example, represent a spectral shape (or spectral envelope) of the high-frequency portion of the input audio information, i.e., a frequency range of the input audio information which is not covered by the low-frequency encoder 120.

However, the audio encoder 100 is configured to decide, in a signal-adaptive manner, whether bandwidth extension information should be included into the encoded audio information 112. Accordingly, the audio encoder 100 is capable of only including the bandwidth extension information into the encoded audio information 112 if the bandwidth extension information is necessitated (or at least desirable)

for a reconstruction of the audio information at the side of an audio decoder. In this context, the audio encoder may also control whether the bandwidth extension information 132 is provided by the bandwidth extension information provider 130 for a portion of the input audio information (or, equivalently, for a portion of the encoded audio information), since it is naturally not necessary to provide bandwidth extension information for a portion of the input audio information (or of the encoded audio information) if the bandwidth extension information shall not be included into the encoded audio information. Accordingly, the audio encoder 100 is capable of keeping the bitrate of the encoded audio information 112 as small as possible by avoiding the inclusion of the bandwidth extension information 132 into the encoded audio information 112 if it is found, on the basis of some analysis process and/or decision process performed by the audio encoder 100, that the bandwidth extension information is not required for obtaining a certain audio quality when reconstructing a corresponding portion of the audio content at the side of an audio decoder.

Thus, the audio encoder 100 only includes the bandwidth extension information into the encoded audio information if it is needed (to obtain a certain audio quality) at the side of an audio decoder, which, on the one hand, helps to reduce the bitrate of the encoded audio information 112 and which, on the other hand, ensures that an appropriate bandwidth extension information 132 is included in the encoded audio information 112 if this is necessitated to avoid a bad audio quality when decoding the encoded audio information at the side of an audio decoder. Thus, an improved tradeoff between bitrate and audio quality is achieved by the audio encoder 100 when compared to conventional solutions.

For example, the audio decoder may decide, per audio frame, whether bandwidth extension information should be included into the encoded audio information 112 (or even whether the bandwidth extension information should be determined). Alternatively, however, the audio decoder may decide, per "input" (for example, per audio file or per audio stream), whether bandwidth extension information should be included into the encoded audio information 112 For this purpose, the input may be analyzed (for example prior to the encoding), such that the decision is made in a signal-adaptive manner.

2. Audio Encoder According to FIG. 2

Figure 2:
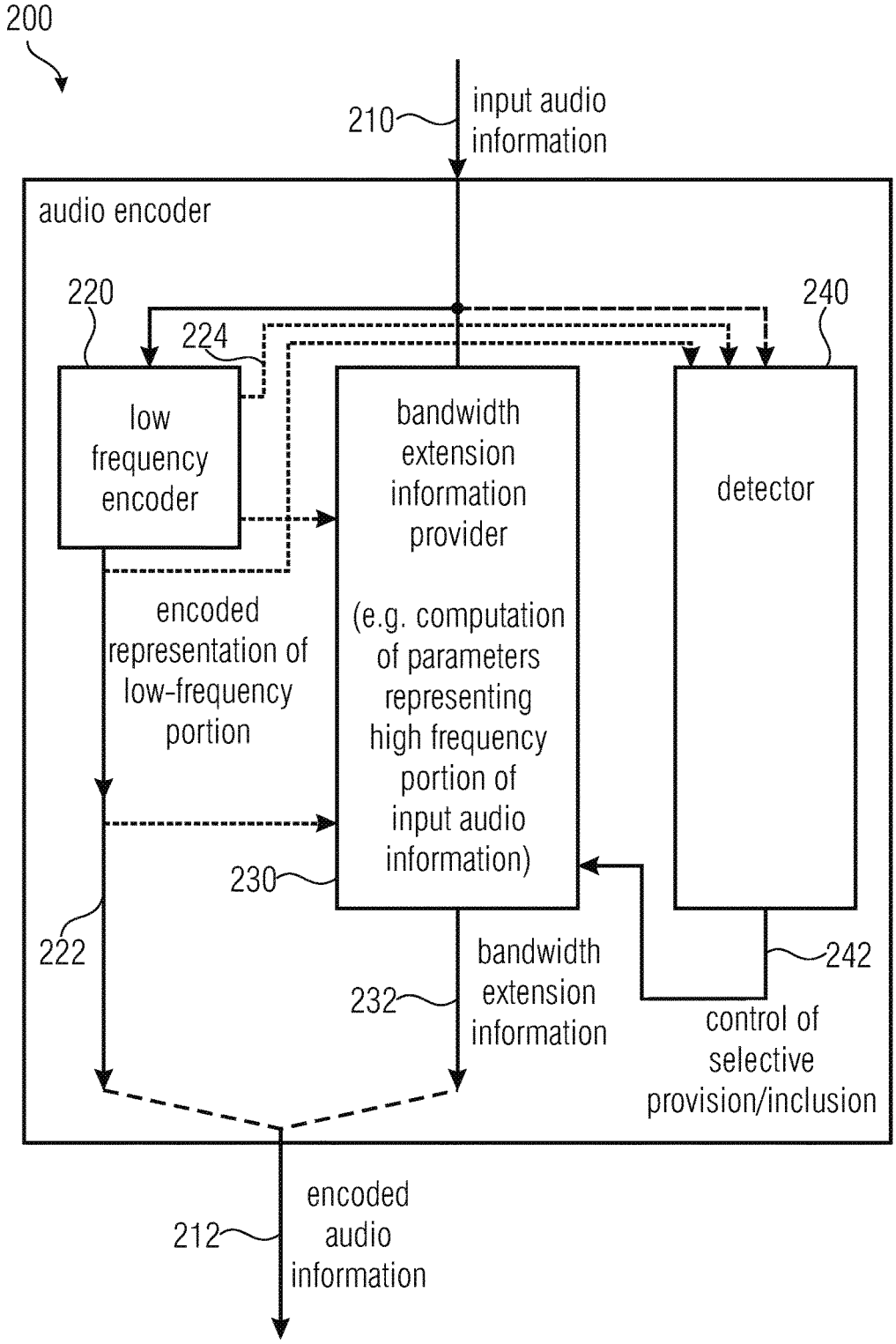
FIG. 2 shows a block schematic diagram of an audio encoder, according to another embodiment of the present invention.

FIG. 2 shows a block schematic diagram of an audio encoder, according to an embodiment of the present invention. The audio encoder 200 receives an input audio information 210 and provides, on the basis thereof, an encoded audio information 212. The audio encoder 200 comprises a low-frequency encoder 220, which may be substantially identical to the low-frequency encoder 120 described above. The low-frequency encoder 220 provides an encoded representation 222 of a low-frequency portion of the input audio information (or, equivalently, of the audio content represented by the input audio information 210). The audio encoder 200 also comprises a bandwidth extension information provider 230, which may be substantially identical to the bandwidth extension information provider 130 described above. The bandwidth extension information provider 230 typically receives the input audio information 210. However, the bandwidth extension information provider 230 may also receive a control information (or intermediate information) from the low-frequency encoder 220, wherein said control information (or intermediate information) may, for example, comprise information about a spectrum (or a spectral shape or spectral envelope) of the low-frequency portion of the input audio information 210. However, the control information (or intermediate information) may also comprise encoding parameters (for example, LPC filter coefficients, or transform domain values, like MDCT coefficients, or QMF coefficients) or the like. Moreover, the bandwidth extension information provider 230 may, optionally, receive the encoded representation 222 of the low-frequency portion, or at least a part thereof. Moreover, the audio encoder 200 comprises a detector 240, which is configured to decide whether bandwidth extension information is included into the encoded audio information 212 for a given portion of the input audio information 210 (or for a given portion of the encoded audio information 212). Optionally, the detector 240 may also determine whether said bandwidth extension information is determined by the bandwidth extension information provider 230 for said given portion of the input audio information 210 (or of the encoded audio information 212). The detector 240 may therefore receive the input audio information 210, and/or a control information or intermediate information 224 from the low-frequency encoder 220 (for example, as described above) and/or the encoded representation 222 of the low-frequency portion. Moreover, the detector 240 is configured to provide a control signal 242 which controls a selective provision of the bandwidth extension information and/or a selective inclusion of the bandwidth extension information into the encoded audio information 212.

Regarding the functionality of the audio encoder 200, reference is made to the above explanations made with respect to the audio encoder 100.

Moreover, it should be noted that the detector 240 comprises a central role, since the detector 240 decides whether the bandwidth extension information is included into the encoded audio information 212 or not, and therefore decides whether an audio decoder, which receives the encoded audio information 212, reconstructs the audio content, which is described by the input audio information 210, using a blind bandwidth extension or using a parameter-guided bandwidth extension (wherein the bandwidth extension information represents the parameters guiding the parameter-guided bandwidth extension).

Generally speaking, the detector identifies portions of the input audio information which cannot be decoded with sufficient or desired quality on the basis of the encoded representation 222 of the low-frequency portion using a blind bandwidth extension. In other words, the detector 240 should recognize when the encoded representation of the low-frequency portion 222 alone does not allow for a blind bandwidth extension with sufficient quality. Worded differently, the detector 240 advantageously identifies portions of the input audio information for which bandwidth extension parameters cannot be estimated on the basis of the low-frequency portion with a sufficient (or desired) accuracy, to reach an acceptable (or desired) audio quality. Consequently, the detector 240 may determine, using the control signal 242, that bandwidth extension information should be included into the encoded audio information for portions of the input audio information which cannot be decoded with a sufficient or desired quality on the basis of the encoded representation 222 of the low-frequency portion using a blind bandwidth extension (i.e. without receiving any bandwidth extension information from the encoder). Equivalently, the detector may determine, using the control signal 242, that bandwidth extension information should be included into the encoded audio information for portions of the input audio information for which bandwidth extension parameters cannot be estimated on the basis of the low-frequency portion (or, equivalently, the encoded representation 222 of the low-frequency portion) with a sufficient or desired accuracy.

In order to identify such portions, for which the bandwidth extension information should be included into the encoded audio information (or, equivalently, to identify portions of the input audio information for which it is not necessary to include the bandwidth extension information into the encoded audio information 212), the detector 240 may use different strategies. As mentioned above, the detector 240 may receive different types of input information. In some cases, the decision of the detector whether the bandwidth extension information should be included into the encoded audio information 212 or not may be based solely on the input audio information 210. In other words, the detector 240 may, for example, be configured to analyze the input audio information 210, to find out for which portions of the input audio information (which correspond to portions of the encoded audio information 212) it is necessitated to include the bandwidth extension information 232 into the encoded audio information 212 to reach an acceptable (or a desired) audio quality. However, the decision of the detector 240 may alternatively be based on some control information or intermediate information 224, provided by the low-frequency encoder 200. Alternatively, or in addition, the decision of the detector 240 may be based on the encoded representation 222 of the low-frequency portion of the input audio information 210. Thus, the detector may evaluate different quantities to determine (or to estimate) whether a blind bandwidth extension at the side of an audio decoder will result in a sufficient audio quality (or is likely to result in a sufficient audio quality, or is expected to result in sufficient audio quality).

For example, the detector may determine whether portions of the input audio information 210 are temporally stationary portions and whether the portions of the input audio information 210 have a low-pass character. For example, the detector 240 may conclude that it is not necessary to include bandwidth extension information into the encoded audio information 212 for portions which are found to be temporally stationary portions and which have a low-pass character, since it has been recognized that such portions of the input audio information 210 can typically be reproduced with sufficiently good audio quality at the side of an audio decoder even using a blind bandwidth extension. This is due to the fact that a blind bandwidth extension typically works well for portions of the input audio information (or content) which do not comprise strong changes of the audio content (or which do not comprise any transients or other strong variations of the audio content) and can therefore be considered as being temporally stationary. Moreover, it has been found that blind bandwidth extension works well for portions of the audio content which comprise a low-pass character, i.e., for a portion of the audio content for which an intensity of a low-frequency portion is higher than an intensity of a high-frequency portion, since this is a fundamental assumption of most blind bandwidth extension concepts. Accordingly, the detector 240 may signal, using the control signal 242, to selectively omit an inclusion of bandwidth extension information into the encoded audio information 212 for such temporally stationary portions having a low-pass character.

For example, the detector 240 may be configured to identify portions of the input audio information which comprise a voiced speech, and/or portions of the input audio information which comprise environmental noise, and/or portions of the input audio information which comprise music without percussive instrumentation. Such portions of the input audio information are typically temporally stationary and comprise a low-pass character, such that the detector 240 typically signals to omit an inclusion of bandwidth extension information into the encoded audio information for such portions.

Alternatively, or in addition, the detector 240 may analyze whether a spectral shape in the high-frequency portion of the input audio information can be predicted with reasonable accuracy (for example, using the concepts applied by blind bandwidth extension) on the basis of a spectral envelope of the low-frequency portion. Accordingly, the detector may, for example, be configured to determine whether a difference between a spectral envelope of a low-frequency portion (which may be described, for example, by the intermediate information 224, or by the encoded representation 222 of the low-frequency portion) and a spectral envelope of a high-frequency portion (which may, for example, be determined by the detector 240 on the basis of the input audio information 210) is larger than or equal to a predetermined difference measure. For example, the detector 240 may determine the difference in terms of an intensity difference, or in terms of a shape difference, or in terms of a variation over frequency, or in terms of any other characteristic features of the spectral envelopes. Accordingly, the detector 240 may decide (and signal) to include bandwidth extension information 232 into the input audio information in response to finding that the difference between the spectral envelope of the low-frequency portion and the spectral envelope of the high-frequency portion is larger than or equal to the predetermined difference measure. In other words, the detector 240 may determine how good the spectral envelope of the high-frequency portion can be predicted on the basis of the spectral envelope of the low-frequency portion, and if the prediction is not possible with good results (which is, for example, the case if the predicted spectral envelope of the high-frequency portion differs too much from the actual spectral envelope of the high frequency portion) it may be concluded that the bandwidth extension information 232 will be necessitated at the side of the audio decoder. However, rather than comparing the predicted spectral envelope of the high-frequency portion with the actual spectral envelope of the high-frequency portion, the detector 240 may, alternatively, compare the spectral envelope of the low-frequency portion with the spectral envelope of the high-frequency portion. This makes sense if it is assumed that the spectral envelope of the high-frequency portion is typically similar to the spectral envelope of the low-frequency portion when applying a blind bandwidth estimation.

Alternatively, or in addition, the detector 240 may identify portions comprising unvoiced speech and/or portions comprising percussive sounds. Since the spectral envelope of the high-frequency portion typically differs strongly from the spectral envelope of the low-frequency portion in such cases, the detector may signal to include the bandwidth extension information into the encoded audio representation for such portions of the input audio information (or of the encoded audio information) comprising unvoiced speech or comprising percussive sounds.

However, alternatively or in addition, the detector 240 may analyze a spectral tilt of portions of the input audio information 210. Also, the detector 240 may use an information about the spectral tilt of portions of the input audio information to decide whether the bandwidth extension information 232 should be included into the encoded audio information 212. Such a concept is based on the idea that blind bandwidth extension works well for portions of an audio content for which there is more energy (or, generally, intensity) in the low-frequency range when compared to the high-frequency range. In contrast, if the high-frequency portion (also designated as high-frequency range) is "dominant", i.e. comprises a substantial amount of energy, blind bandwidth extension typically cannot well-reproduce the audio content, such that the bandwidth extension information should be included into the encoded audio information. Accordingly, in some embodiments the detector determines whether the spectral tilt (which describes a distribution of the energies, or generally intensities, over frequency) is larger than or equal to a fixed or variable tilt threshold value. If the spectral tilt is larger than or equal to the fixed or variable tilt threshold value (which means that there is a comparatively large energy, or intensity, in the high-frequency portion of the audio content, at least when compared to a "normal" case in which the energy or intensity decreases with increasing frequency), the detector may decide to include the bandwidth extension information into the encoded audio information.

In addition to some or all of the above mentioned features, the detector may also evaluate a zero-crossing rate of portions of the input audio information. Moreover, the detector's decision whether to include the bandwidth extension information may also be based on whether the determined zero-crossing rate is larger than or equal to a fixed or variable zero-crossing rate threshold value. This concept is based on the consideration that a high zero-crossing rate typically indicates that high frequencies play an important role in the input audio information, which in turn indicates that a parameter-guided bandwidth extension should be used at the side of an audio decoder.

Moreover, it should be noted that the detector 240 may use some hysteresis to avoid an excessive switching between the inclusion of the bandwidth extension information 232 into the encoded audio information and an omission of said inclusion. For example, the hysteresis may be applied to the variable tilt threshold value, to the variable zero-crossing rate threshold value or to any other threshold value which is used to decide about a transition from an inclusion of the bandwidth extension information to an avoidance of said inclusion, or vice versa. Thus, the hysteresis may vary a threshold value in order to reduce a probability for switching to an omission of the inclusion of the bandwidth extension information when the bandwidth extension information is included for a current portion of the input audio information. Analogously, the threshold value may be varied to reduce a probability for switching to the inclusion of the bandwidth extension information when the inclusion of the bandwidth extension information is avoided for the current portion of the input audio information. Thus, artifacts, which may be caused by transitions between the different modes may be reduced.

Figure 3:
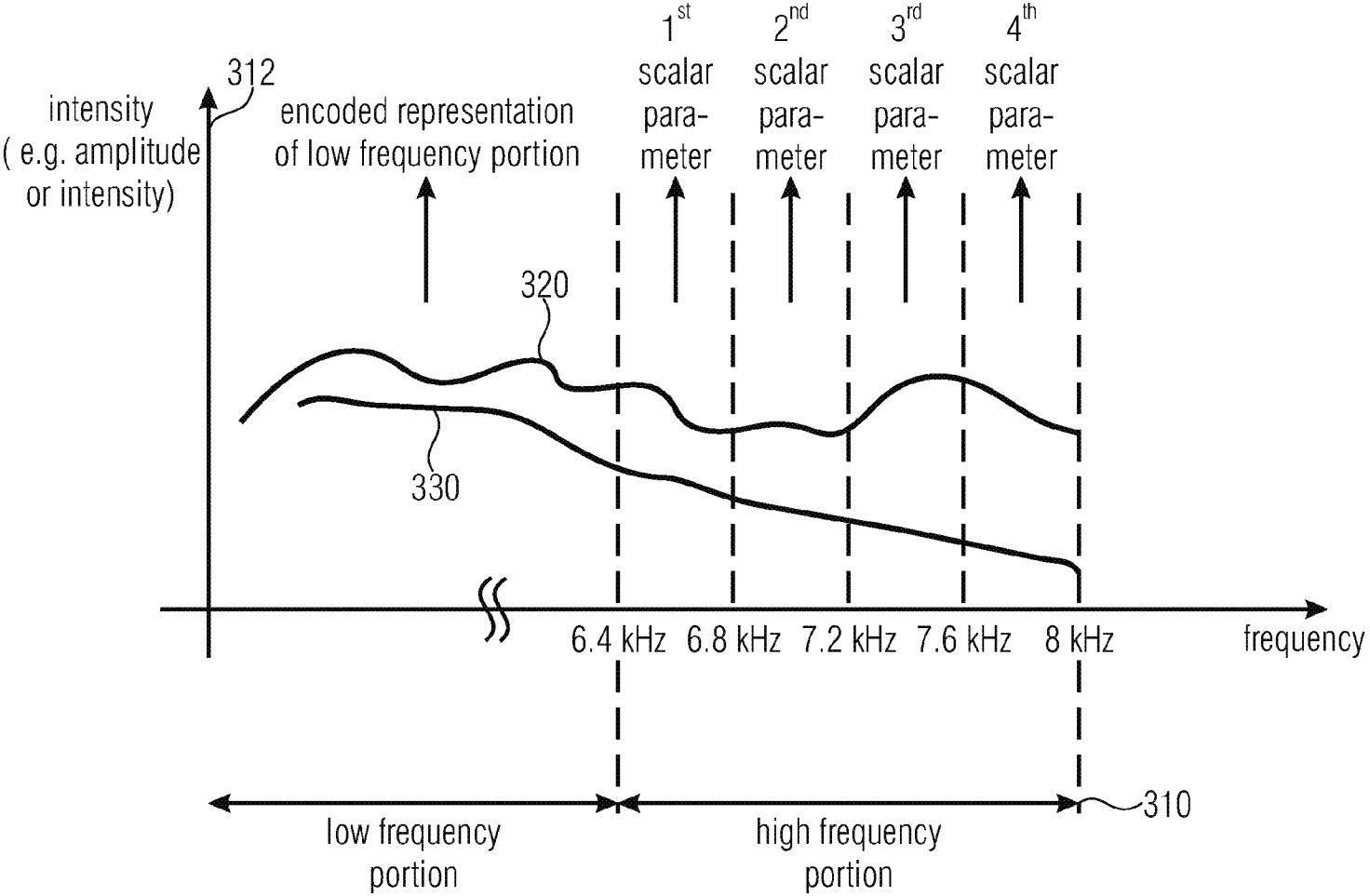
FIG. 3 shows a graphic representation of frequency portions and the encoded audio information associated therewith.

In the following, some details about the bandwidth extension information provider 230 will be discussed. In particular, it will be explained which information is included into the encoded audio information 212 in response to the detector signaling that bandwidth extension information 232 should be included into the encoded audio information. For the purpose of the explanations, reference will also be made to FIG. 3, which shows a schematic representation of frequency portions of the input audio information and of parameters included into the encoded audio representation. An abscissa 310 describes a frequency and an ordinate 312 describes an intensity (for example, an intensity, like an amplitude or an energy) of different spectral bins (like, for example, MDCT coefficients, QMF coefficients, FFT coefficients, or the like). As can be seen, a low-frequency portion of the input audio information may, for example, cover a frequency range from a lower frequency boundary (for example, 0, or 50 Hz, or 300 Hz, or any other reasonable lower frequency boundary) up to a frequency of approximately 6.4 kHz. As can be seen, the encoded representation 222 may be provided for this low-frequency portion (for example, from 300 Hz to 6.4 kHz, or the like). Moreover, there is a high-frequency portion which, for example, ranges from 6.4 kHz to 8 kHz. However, a high-frequency portion may naturally cover a different frequency range which is typically limited by the frequency range perceptible by a human listener. However, it can be seen in FIG. 3 that, as an example, a spectral envelope shown at reference numeral 320 comprises an irregular shape in the high-frequency portion. Moreover, it can be seen that the spectral envelope 320 comprises a comparatively large energy in the high-frequency portion, and even a comparatively high energy between 7.2 kHz and 7.6 kHz. As a comparison, a second spectral envelope 330 is also shown in FIG. 3, wherein the second spectral envelope 330 shows a decay of the intensity or energy (for example, per unit frequency) in the high-frequency portion. Accordingly, the spectral envelope 320 will typically cause the detector to decide for an inclusion of the bandwidth extension information into the encoded audio representation for the portion comprising the spectral envelope 320, while the spectral envelope 330 will typically cause the detector to decide for an omission of the inclusion of the bandwidth extension information for the portion of the audio content comprising the spectral envelope 330.

As can be further seen, for a portion of the audio content comprising the spectral envelope 320, four scalar parameters will be include into the encoded audio representation as a bandwidth extension information. A first scalar parameter may, for example, describe the spectral envelope (or an average of the spectral envelope) for the frequency region between 6.4 kHz and 6.8 kHz, a second scalar parameter may describe the spectral envelope 320 (or the average thereof) for the frequency region between 6.8 kHz and 7.2 kHz, a third scalar parameter may describe the spectral envelope 320 (or an average thereof) for the frequency region between 7.2 kHz and 7.6 kHz, and a fourth scalar parameter may describe the spectral envelope (or an average thereof) for the frequency region between 7.6 kHz an 8 kHz. The scalar parameters may describe the spectral envelope in an absolute or relative manner, for example, with reference to a spectrally preceding frequency range (or region). For example, the first scalar parameter may describe an intensity ratio (which may, for example, be normalized to some quantity) between the spectral envelope in the frequency region between 6.4 kHz and 6.8 kHz and the spectral envelope in a lower frequency region (for example, below 6.4 kHz). The second, third and fourth scalar parameters may, for example, describe a difference (or ratio) between (intensities of) the spectral envelope in adjacent frequency ranges, such that, for example, the second scalar parameter may describe a ratio between (an average value of) the spectral envelope in the frequency range between 6.8 kHz and 7.2 kHz and the spectral envelope in the frequency range between 6.4 kHz and 6.8 kHz.

Moreover, it should be noted that an encoded representation of the low-frequency portion, i.e., the frequency portion below 6.4 kHz, may be included in any case. The frequency portion below 6.4 kHz (low-frequency portion) may be encoded using any of the well-known encoding concepts, for example using a "general audio" encoding like AAC (or a derivative thereof) or a speech coding (like, for example, CELP, ACELP, or a derivative thereof). Accordingly, for a portion of the audio content comprising the spectral envelope 320, both an encoded representation of the low-frequency portion and four scalar bandwidth extension parameters (which may be quantized using a comparatively small number of bits) will be included into the encoded audio representation. In contrast, for a portion of the audio content comprising the spectral envelope 330, only the encoded representation of the low-frequency portion will be included into the encoded audio representation, but no (scalar) bandwidth extension parameters will be included into the encoded audio representation (which, nevertheless, does not cause serious problems since the spectral envelope 330 exhibits a regular and decaying (low-pass) characteristic, which can be well-reproduced using a blind bandwidth extension).

To conclude, the audio encoder 200 is configured to selectively include parameters representing a spectral envelope of a high-frequency portion of the input audio information into the encoded audio information in a signal-adaptive manner as a bandwidth extension information. For example, the scalar bandwidth extension parameters mentioned taking reference to FIG. 3 can be included into the encoded audio information in a signal-adaptive manner. Generally speaking, the lower frequency encoder 220 may be configured to encode a low-frequency portion of the input audio information 210, comprising frequencies up to a maximum frequency which lies in a range between 6 and 7 kHz (wherein a border of 6.4 kHz has been used in the example of FIG. 3). Moreover, the audio encoder may be configured to selectively include into the encoded audio representation between three and five parameters describing intensities of high-frequency signal portions having bandwidths between 300 Hz and 500 Hz. In the example of FIG. 3, four scalar parameters describing intensities of the high-frequency signal portions having bandwidths of approximately 400 Hz have been shown. In other words, the audio encoder may be configured to include into the encoded audio representation four scalar quantized parameters describing intensities of four high-frequency signal portions, the high-frequency signal portions covering frequency ranges (for example as shown in FIG. 3) above the low frequency portion (for example, as explained with reference to FIG. 3). For example, the audio encoder may be configured to selectively include into the encoded audio representation a plurality of parameters describing a relationship between energies or intensities of spectrally adjacent frequency portions, wherein one of the parameters describes a ratio between an energy or intensity of a first bandwidth extension high-frequency portion and an energy or intensity of a low-frequency portion, and wherein other of the parameters described ratios between energies or intensities of other bandwidth extension high-frequency portions (wherein the bandwidth extension high-frequency portions may be the frequency portions between 6.4 and 6.8 kHz, between 6.8 and 7.2 kHz, between 7.2 kHz and 7.6 kHz and between 7.6 kHz and 8 kHz. Alternatively, the between three and five envelope shape parameters (describing intensities of high-frequency signal portions) may be vector quantized. Vector quantization is typically somewhat more efficient than scalar quantization. On the other hand, vector quantization is more complex than scalar quantization. In other words, the quantization of the four bandwidth extension energy values can alternatively be performed using a vector quantization (rather than using a scalar quantization).

To conclude, the audio encoder may be configured to include a comparatively simple bandwidth extension information into the encoded audio representation, such that a bitrate of the encoded audio representation is only slightly increased for portions of the input audio information (or of the encoded audio representation) for which it is found, by the detector, that a parameter-guided bandwidth extension would be desirable.

3. Audio Decoder According to FIG. 4

Figure 4:
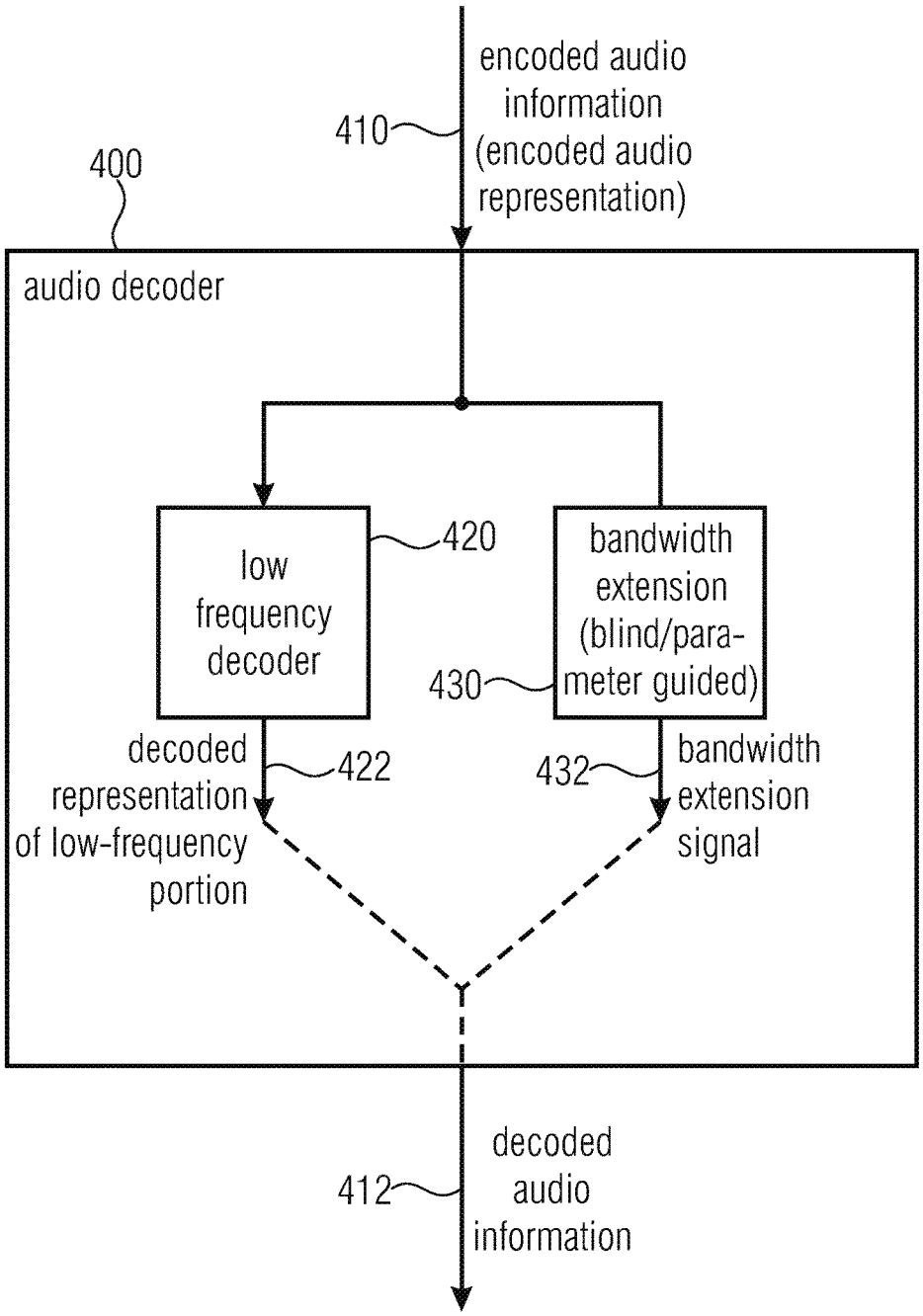
FIG. 4 shows a block schematic diagram of an audio decoder, according to an embodiment of the present invention.

FIG. 4 shows a block schematic diagram of an audio decoder according to an embodiment of the present invention. The audio decoder 400 according to FIG. 4 receives an encoded audio information 410 (which may, for example, be provided by the audio encoder 100 or by the audio encoder 200), and provides, on the basis thereof, decoded audio information 412.

The audio decoder 400 comprises a low-frequency decoder 420, which receives the encoded audio information 410 (or at least the encoded representation of the low-frequency portion included therein), decodes the encoded representation of the low-frequency portion, and obtains a decoded representation 422 of the low-frequency portion. The audio decoder 400 also comprises a bandwidth extension 430 which is configured to obtain a bandwidth extension signal 432 using a blind bandwidth extension for portions of the (encoded) audio content (represented by the encoded audio information 410) for which no bandwidth extension parameters are included in the encoded audio information 410, and obtains the bandwidth extension signal 432 using a parameter-guided bandwidth extension (making use of bandwidth extension information or bandwidth extension parameters included in the encoded audio information 410) for portions of the audio content for which bandwidth extension parameters are included in the encoded audio information (or encoded audio representation) 410.

Accordingly, the audio decoder 400 is capable of performing a bandwidth extension irrespective of whether bandwidth extension parameters are included in the encoded audio information 410 or not. Thus, the audio decoder can adapt to the encoded audio information 410 and allows for a concept in which there is a switching between a blind bandwidth extension and a parameter-guided bandwidth extension. Consequently, the audio decoder 400 is capable of handling an encoded audio information 410 in which bandwidth extension parameters are only included for portions (for example frames) of the audio content which cannot be reconstructed with sufficient quality using a blind bandwidth extension. Thus, the decoded audio information 412, which comprises both the decoded representation of the low-frequency portion and the bandwidth extension signal (wherein the latter may, for example, be added to the decoded representation 422 of the low-frequency portion to thereby obtain the decoded audio information 412) may be provided.

Thus, the audio decoder 400 helps to obtain a good tradeoff between audio quality and bitrate.

A further optional improvement of the audio decoder 400 will be described below, for example, taking reference to FIG. 5.

4. Audio Decoder According to FIG. 5

Figure 5:
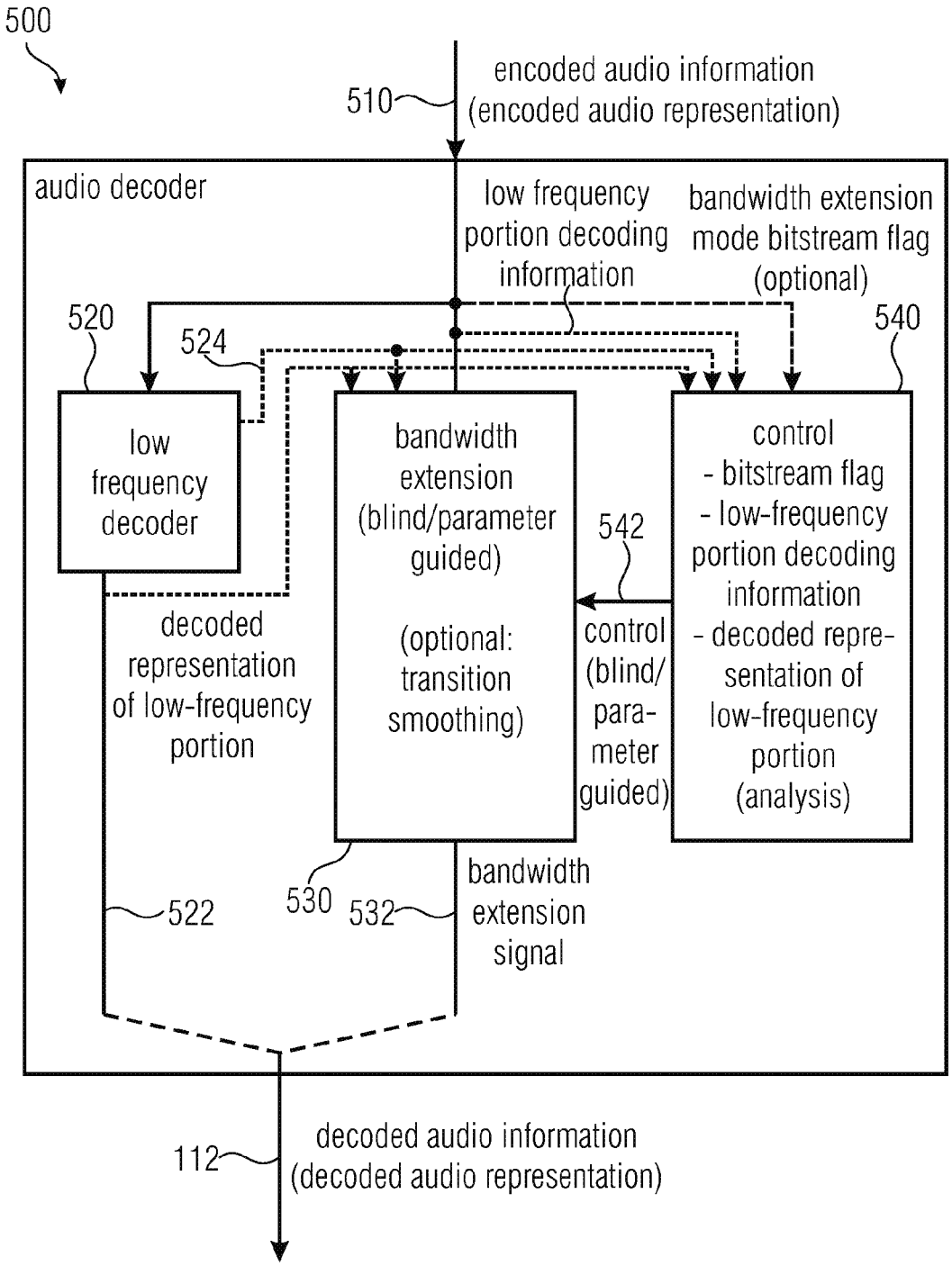
FIG. 5 shows a block schematic diagram of an audio decoder, according to another embodiment of the present invention.

FIG. 5 shows a block schematic diagram of an audio decoder 500, according to another embodiment of the present invention. The audio decoder 500 receives an encoded audio information (also designated as encoded audio representation) 510 and provides, on the basis thereof, a decoded audio information (also designated as decoded audio representation) 512. The audio decoder 500 comprises a low-frequency decoder 520, which may be equal to the low-frequency decoder 420 and may fulfill a comparable functionality. Thus, the low-frequency decoder 500 provides a decoded representation 522 of a low-frequency portion of an audio content represented by the encoded audio information 510. The audio decoder 500 also comprises a bandwidth extension 530, which may fulfill the same functionality as the bandwidth extension 430.

The bandwidth extension 530 may therefore provide a bandwidth extension signal 532, which is typically combined with (for example, added to) the decoded representation 522 of the low-frequency portion, to thereby obtain the decoded audio information 512. The bandwidth extension 530 may, for example, receive the decoded representation 522 of the low-frequency portion 522. Alternatively, however, the bandwidth extension 532 may receive a control information (which will also be considered as an auxiliary information or an intermediate information) 524, which is provided by the low-frequency decoder 520. The auxiliary information or control information or intermediate information 524 may, for example, represent a spectral shape of the low-frequency portion of the audio content, a zero-crossing rate of the decoded representation of the low-frequency portion, or any other intermediate quantity used by the low-frequency decoder 520 which is helpful in the process of bandwidth extension. Moreover, the audio decoder comprises a control 540, which is configured to provide a control information 542 indicating whether a blind bandwidth extension or a parameter-guided bandwidth extension should be performed by the bandwidth extension 530. The control 540 may use different types of information for providing the control information 542. For example, the control 540 may receive a bandwidth extension mode bitstream flag, which may be included in the encoded audio information 510. For example, there may be one bandwidth extension mode bitstream flag for each portion (for example, frame) of the encoded audio information, which can be extracted from the encoded audio information by the control 540, and which may be used to derive the control information 542 (or which may immediately constitute the control information 542). Alternatively, however, the control 540 may receive an information which represents the low-frequency portion, and/or which describes how to decode the low-frequency portion (and which is therefore also designated as "low-frequency portion decoding information"). Alternatively, or in addition, the control 540 may receive the control information or auxiliary information or intermediate information 524 from the low-frequency decoder, which may, for example, carry information about a spectral envelope of the low-frequency portion, and/or an information about the zero-crossing rate of the decoded representation of the low-frequency portion. However, the control information or auxiliary information or intermediate information 524 may also carry an information about statistics of the decoded representation 522 of the low-frequency portion, or may represent any other intermediate information which is derived by the low-frequency decoder 520 from the encoded representation of the low-frequency portion (also designated as low-frequency portion decoding information).

Alternatively, or in addition, the control 540 may receive the decoded representation 522 of the low-frequency portion and may itself derive feature values (for example, a zero-crossing rate information, a spectral envelope information, a spectral tilt information, or the like) from the decoded representation 522 of the low-frequency portion.

Accordingly, the control 540 may evaluate a bitstream flag to provide the blind/parameter-guided control information 542, if such a bitstream flag (signaling whether a blind bandwidth extension or a parameter-guided bandwidth extension should be used) is included in the encoded audio information 510. If, however, no such bitstream flag is included in the encoded audio information 510 (for example, to save bitrate) the control 540 typically determines whether to use a blind bandwidth extension or a parameter-guided bandwidth extension on the basis of other information. For this purpose, the low-frequency portion decoding information (which may be equal to the encoded representation of the low-frequency portion, or to a subset thereof) may be evaluated by the control 540. Alternatively, or in addition, the control may consider the decoded representation 522 of the low-frequency portion for making a decision whether to use a blind bandwidth extension or a parameter-guided bandwidth extension, i.e., for providing the control information 542. Moreover, the control 540 may, optionally, use the control information or auxiliary information or intermediate information 524 provided by the low-frequency decoder 520, provided that the low-frequency decoder 520 provides any intermediate quantities which are usable by the control 540.

Accordingly, the control 540 may switch the bandwidth extension between the blind bandwidth extension and the parameter-guided bandwidth extension.

In the case of a blind bandwidth extension, the bandwidth extension 530 may provide the bandwidth extension signal 532 on the basis of the decoded representation 522 of the low-frequency portion without evaluating any additional bitstream parameters. In contrast, in the case of a parameter-guided bandwidth extension, the bandwidth extension 530 may provide the bandwidth extension signal 532 taking into consideration additional (dedicated) bandwidth extension bitstream parameters, which assist to determine characteristics of the high-frequency portion of the audio content (i.e., characteristics of the bandwidth extension signal). However, the bandwidth extension 530 may also use the decoded representation 522 of the low-frequency portion, and/or the control information or auxiliary information or intermediate information 524 provided by the low-frequency decoder 520, to provide the bandwidth extension signal 532.

Thus, the decision between the usage of a blind bandwidth extension and a parameter-guided bandwidth extension effectively determines whether dedicated bandwidth extension parameters (which are typically not used by the low-frequency decoder 520 to provide the decoded representation of the low-frequency portion) are applied to obtain the bandwidth extension signal (which typically describes the high-frequency portion of the audio content represented by the encoded audio information).

To summarize the above, the audio decoder 500 may be configured to decide whether to obtain the bandwidth extension signal 532 using a blind bandwidth extension or using a parameter-guided bandwidth extension on a frame-by-frame basis (wherein a "frame" is an example of a portion of the audio content, and wherein a frame may, for example, comprise a duration between 10 ms and 40 ms, and may have a duration of approximately 20 ms±2 ms). Thus, the audio decoder may be configured to switch between a blind bandwidth extension and a parameter-guided bandwidth extension with a very fine temporal granularity.

Also, it should be noted that the audio decoder 500 is typically capable to switch between a usage of a blind bandwidth extension and a parameter-guided bandwidth extension within a contiguous piece of audio content. Thus, the switching between the blind bandwidth extension and the parameter-guided bandwidth extension can be performed substantially at any time (naturally considering the framing)

within a contiguous piece of audio content, to adapt the bandwidth extension to the (changing) characteristics of the different portions of a single piece of audio content.

As mentioned before, the audio decoder (advantageously the control 540) may be configured to evaluate flags (for example, one single bit flag per frame) included in the encoded audio information 510 for different portions (for example frames) of the audio content, to decide whether to use a blind bandwidth extension or a parameter-guided bandwidth extension. In this case, the control 540 can be kept very simple, at the expense that a signaling flag must be included in the encoded audio information for each portion of the audio content. Alternatively, however, the control 540 may be configured to decide whether to use a blind bandwidth extension or a parameter-guided bandwidth extension on the basis of the encoded representation of the low-frequency portion (which may include the usage of the control information or auxiliary information or intermediate information 524 derived by the low-frequency decoder 520 from said encoded representation of the low-frequency portion, and which may also include the usage of the decoded representation 522, which is derived from the encoded representation of the low-frequency portion by the low-frequency decoder 520) without evaluating a (dedicated) bandwidth extension mode signaling flag. Thus, a switching between the blind bandwidth extension and the parameter-guided bandwidth extension can be performed even without a signaling overhead in the bitstream.

The audio decoder (or the control 540) may be configured to decide whether to use a blind bandwidth extension or a parameter-guided bandwidth extension on the basis of one or more features of the decoded representation of the low-frequency portion. Such features, like, for example, a spectral tilt information, a zero-crossing rate information, or the like, may be either extracted from the decoded representation 522 of the low-frequency portion, or may be signaled by the control information/auxiliary information/intermediate information 524. For example, the audio decoder (or the control 540) may be configured to decide whether to use a blind bandwidth extension or a parameter-guided bandwidth extension on the basis of quantized linear prediction coefficients (which may, for example, be included in the control information/auxiliary information/intermediate information 524) and/or in dependence on time domain statistics of the decoded representation 522 of the low-frequency portion.

In the following, some concepts how to achieve the bandwidth extension will be described. For example, the bandwidth extension may be configured to obtain the bandwidth extension signal 532 using one or more features of the decoded representation 522 of the low-frequency portion and/or one or more parameters of the low-frequency decoder 520 (which may be signaled by the control information/auxiliary information/intermediate information 524) for temporal portions of the (input) audio content for which no bandwidth extension parameters are included in the encoded audio information. Thus, the bandwidth extension 530 may perform a blind bandwidth extension, which is based on the idea to conclude from the decoded representation of the low-frequency portion to the high-frequency portion of the audio content represented by the encoded audio information. For example, bandwidth extension 530 may be configured to obtain the bandwidth extension signal 532 using a spectral centroid information, and/or using an energy information, and/or using (for example, coded) filter coefficients for temporal portions of the input audio content for which no bandwidth extension parameters are included in the encoded audio information 510. Accordingly, a good blind bandwidth extension can be achieved.

However, different blind bandwidth extension concepts may naturally also be applied.

However, the bandwidth extension may be configured to obtain the bandwidth extension signal 532 using bitstream parameters describing a spectral envelope of a high-frequency portion for temporal portions of the audio content for which bandwidth extension parameters are included in the encoded audio information. In other words, the parameter-guided bandwidth extension may be performed using bitstream parameters describing the spectral envelope of the high-frequency portion. The bitstream parameters describing the spectral envelope of the high-frequency portion may support the parameter-guided bandwidth extension (which may, nevertheless, additionally rely on some or all of the quantities used by the blind bandwidth extension).

For example, it has been found that the bandwidth extension should be configured to evaluate between three and five bitstream parameters describing intensities of high-frequency signal portions having bandwidths between 300 Hz and 500 Hz, in order to obtain the bandwidth extension signal. The usage of such a comparatively small number of bitstream parameters does not substantially increase the bitrate but still brings along a sufficient improvement of the bandwidth extension in the case of "difficult" signal portions, such that the quality achievable by the thus guided bandwidth extension for "difficult" signal portions is comparable to the quality obtainable for "easy" signal portions using the blind bandwidth extension (wherein "difficult" signal portions are signal portions for which blind bandwidth extension would not result in a good or acceptable audio quality, while "easy" signal portions are signal portions for which blind bandwidth extension brings along sufficient results).

Accordingly, it is of advantage that the between three and five bitstream parameters describing intensities of high-frequency signal portions having bandwidths between 300 Hz and 500 Hz are scalar quantized with two or three bits resolution, such that there are between 6 and 15 bits of bandwidth extension spectral shaping parameters per frame. It has been found that such a low bitrate of the bandwidth extension information is already sufficient to obtain a reasonably good bandwidth extension in the case of "difficult" portions of the audio content.

Optionally, the bandwidth extension 530 may be configured to perform a smoothing of energies of the bandwidth extension signal when switching from blind bandwidth extension to parameter-guided bandwidth extension and/or when switching from parameter-guided bandwidth extension to blind bandwidth extension. Accordingly, discontinuities in the spectral shape when switching between blind bandwidth extension and parameter-guided bandwidth extension are reduced. For example, the bandwidth extension may be configured to dampen a high-frequency portion of the bandwidth extension signal for a portion of the audio content to which a parameter-guided bandwidth extension is applied following a portion of the audio content to which a blind bandwidth extension is applied. Also, the bandwidth extension may be configured to reduce a damping for a high-frequency portion of the bandwidth extension signal (i.e., to somewhat emphasize a high-frequency portion of the bandwidth extension signal) for a portion of the audio content to which a blind bandwidth extension is applied following a portion of the audio content to which a parameter-guided bandwidth extension is applied. However, a smoothing may also be performed by any other operation which reduces discontinuities of the spectral shape of the high-frequency portion when switching between bandwidth extension modes. Thus, an audio quality is improved by reducing artifacts.

To conclude, the audio decoder 500 allows for a good quality decoding of an audio content both in the case that a bandwidth extension information is provided in the encoded audio information and for the case that no bandwidth extension information is provided in the encoded audio information. The audio decoder can switch between a blind bandwidth extension and a parameter-guided bandwidth extension with fine temporal granularity (for example, on a frame-by-frame basis) wherein artifacts are kept small.

5. Method for Providing an Encoded Audio Information on the Basis of an Input Audio Information, According to FIG. 6

Figure 6:
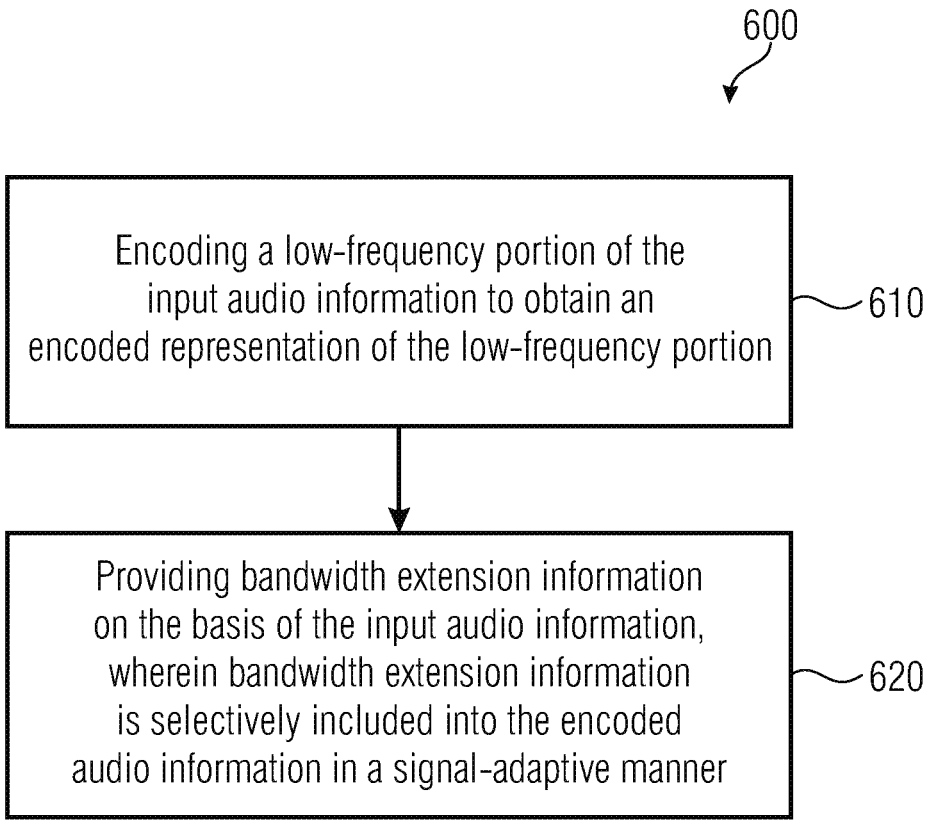
FIG. 6 shows a flowchart of a method for providing an encoded audio representation, according to an embodiment of the present invention.

FIG. 6 shows a flowchart of a method 600 for providing an encoded audio information on the basis of an input audio information. The method 600 comprises encoding 610 a low-frequency portion of the input audio information to obtain an encoded representation of the low-frequency portion. The method 600 also comprises providing 620 bandwidth extension information on the basis of the input audio information, wherein bandwidth extension information is selectively included into the encoded audio information in a signal-adaptive manner.

It should be noted that the method 600 according to FIG. 6 can be supplemented by any of the features and functionalities described herein with respect to the audio encoder (and also with respect to the audio decoder).

6. Method for Providing a Decoded Audio Information According to FIG. 7

Figure 7:
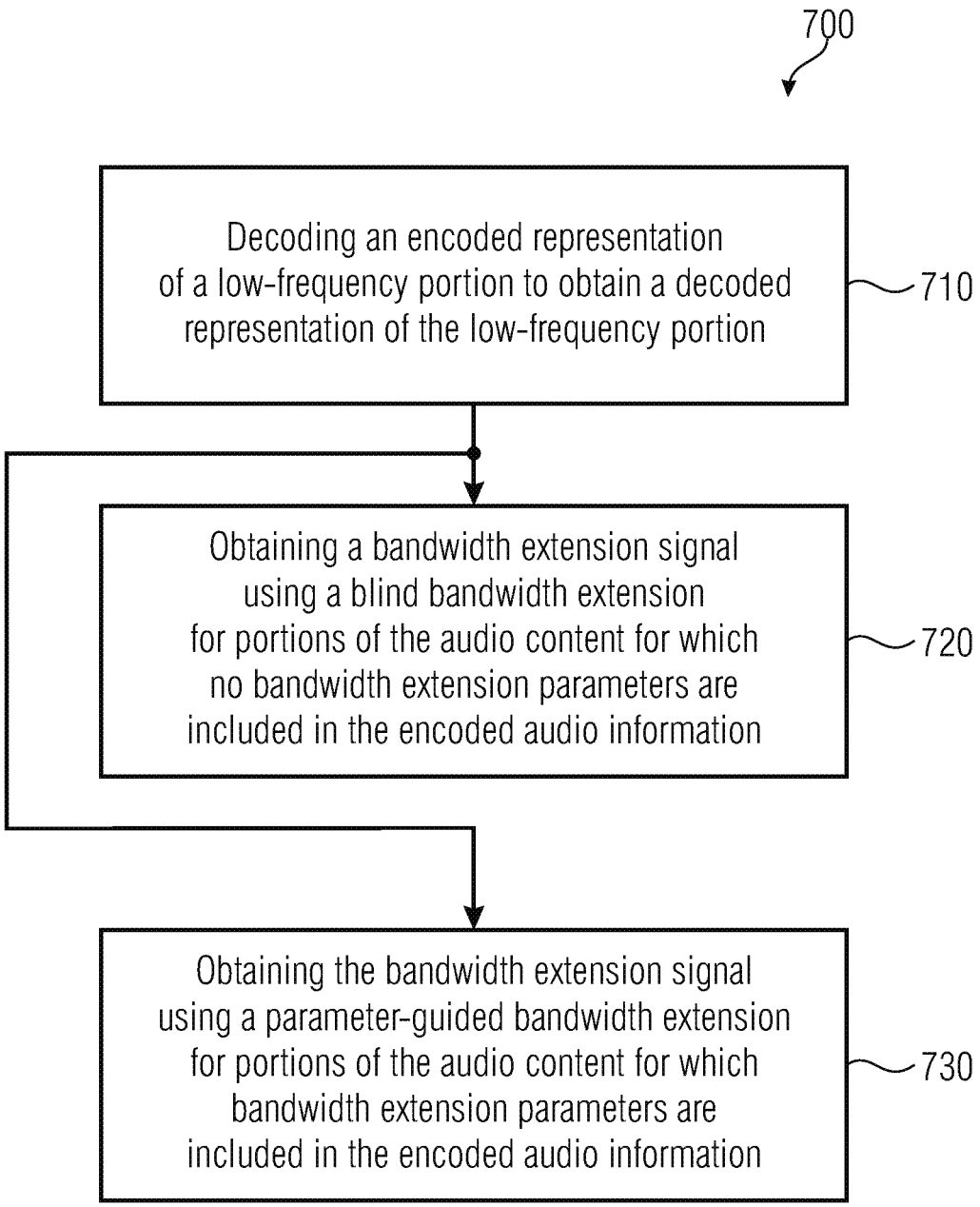
FIG. 7 shows a flowchart of a method for providing a decoded audio representation, according to an embodiment of the present invention.

FIG. 7 shows a flowchart of a method for providing a decoded audio information, according to an embodiment of the invention. The method 700 comprises decoding 710 an encoded representation of a low-frequency portion to obtain a decoded representation of the low-frequency portion. The method 700 also comprises obtaining 720 a bandwidth extension signal using a blind bandwidth extension for portions of an audio content for which no bandwidth extension parameters are included in the encoded audio information. Furthermore, the method 700 comprises obtaining 730 the bandwidth extension signal using a parameter-guided bandwidth extension for portions of the audio content for which bandwidth extension parameters are included in the encoded audio information.

It should be noted that the method 700 according to FIG. 7 can be supplemented by any of the features and functionalities described herein with respect to the audio decoder (and also with respect to the audio encoder).

7. Encoded Audio Representation According to FIG. 8

Figure 8:
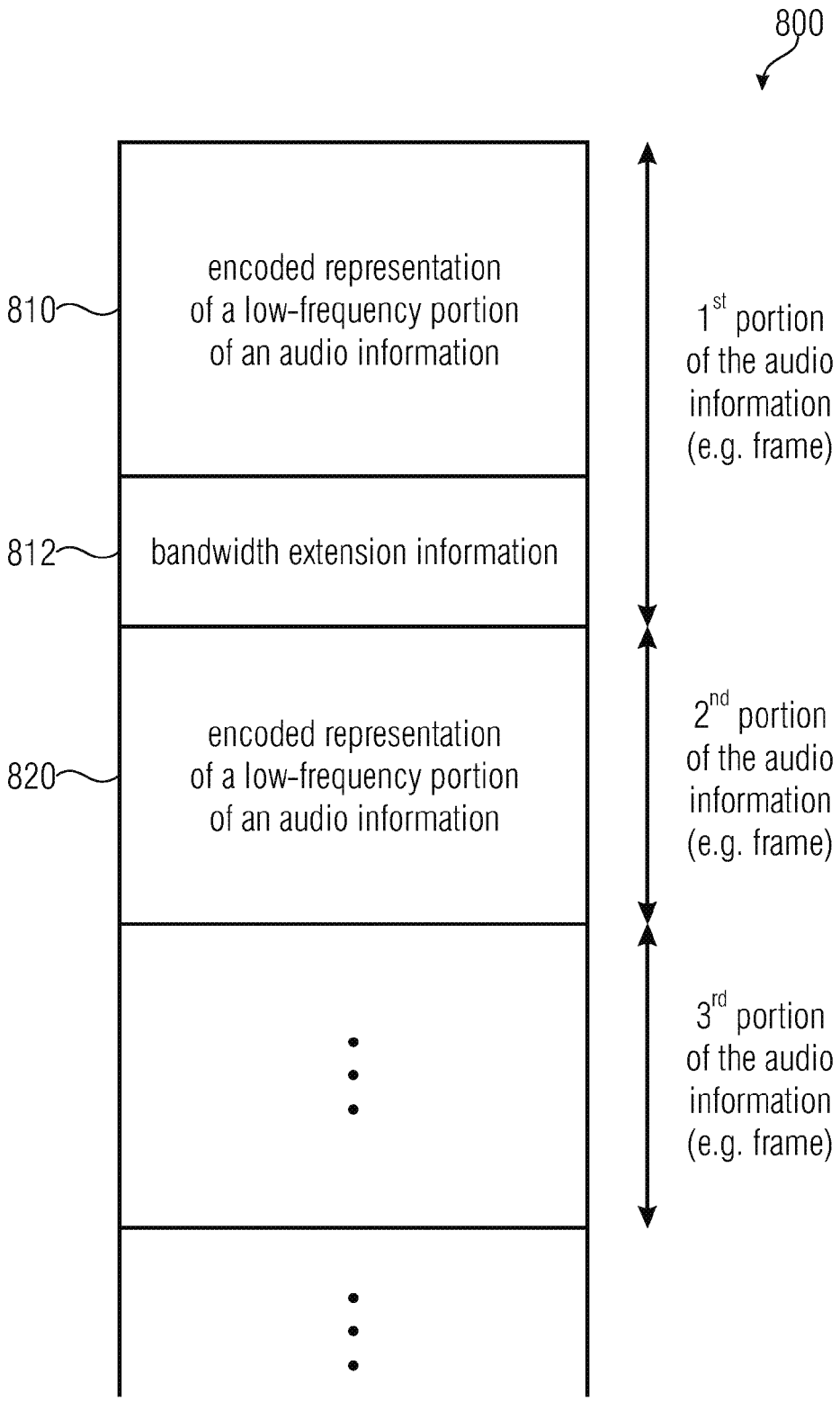
FIG. 8 shows a schematic illustration of an encoded audio representation, according to an embodiment of the present invention.

FIG. 8 shows a schematic illustration of an encoded audio representation 800 representing an audio information.

The encoded audio representation (also designated as encoded audio information) comprises an encoded representation of a low-frequency portion of the audio information. For example, an encoded representation 810 of a low-frequency portion of an audio information is provided for a first portion of the audio information, for example, for a first frame of the audio information. Moreover, an encoded representation of a low-frequency portion of the audio information is also provided for a second portion (for example a second frame) of the audio information. However, the encoded audio representation 800 also comprises a bandwidth extension information, wherein the bandwidth extension information is included in the encoded audio representation in a signal-adaptive manner for some but not for all portions of the audio information. For example, a bandwidth extension information 812 is included for the first portion of the audio information. In contrast, no bandwidth extension information is provided for the second portion of the audio information.

To conclude, the encoded audio representation 800 is typically provided by the audio encoders described herein, and evaluated by the audio decoders described herein. Naturally, the encoded audio representation may be stored on a non-transitory computer-readable medium, or the like. Moreover, it should be noted that the encoded audio representation 800 may be supplemented by any of the features, information items, etc, described with respect to the audio encoder and the audio decoder.

8. Conclusions and Further Aspects

Embodiments according to the present invention address the problems of conventional bandwidth extension in very-low-bitrate audio coding and the shortcomings of the existing, conventional bandwidth extension techniques by proposing a "minimally guided" bandwidth extension as a signal-adaptive combination of a blind and a parameter-guided bandwidth extension which

- uses a guided bandwidth extension, i.e., transmits a few bits of side information per 20 ms (for example, per audio frame), only if the high-frequency content (for example, the high-frequency portion) of the input audio cannot be reconstructed well enough from the low-frequency audio (for example, the low-frequency portion of the audio content),
- uses a blind bandwidth extension, i.e., classical reconstruction of high-frequency components (for example, of a high-frequency portion) from low-frequency core features (for example, features of a reconstructed low-frequency portion) such as spectral centroid, energy, tilt, encoded filter coefficients, otherwise,
- exhibits very low computational complexity by utilizing scalar instead of vector quantization of the side information and by avoiding operations involving large amounts of data points, such as Fourier transforms and autocorrelation and/or filter computations,
- is robust with respect to input signal characteristics, i.e. is not optimized for particular input signals, such as adult speech in quiet environments, in order to work well on all types of speech as well as music.

The question which parameter(s) to transmit as side information in the guided bandwidth extension part of embodiments according to the present invention, and when to transmit the parameters, remains to be answered.

It was found that in wideband codecs such as AMR-WB, the spectral envelope of the high-frequency region above the core-coder region represents the most critical data necessitated (or desirable) to perform bandwidth extension with adequate quality. All other parameters, such as spectral fine-structure and temporal envelope, can be derived from the decoded core signal quite accurately or are of little perceptual importance. The guided part of the minimally-guided bandwidth extension described here therefore only transmits the high-frequency spectral envelope as side information (for example, as bandwidth extension information). This aids in keeping the bandwidth extension side information rate low. Furthermore, it was discovered experimentally that blind bandwidth extensions provide sufficient, i.e., at least acceptable, quality on temporally stationary signal passages with a more or less pronounced low-pass character. Voiced speech, environmental noise and music sections without percussive instrumentation are common examples.

In fact, most input to a wideband speech and audio coding system typically falls into this category.

Signal segments, however, whose instantaneous spectra exhibit a very different envelope in the high frequency region (for example, in the high-frequency portion) than in the low frequency (core-coder) region (or low-frequency portion) are, advantageously, to be coded via a guided bandwidth extension transmitting a quantized representation of the high-frequency spectral envelope as side-information (for example, as bandwidth extension information). The reason is that on such spectral constitutions, blind bandwidth extensions are generally unable to predict the high-frequency spectral envelope progression from the core-signal envelope, as given by the coded filter coefficients or the spectrally shaped residual signal (also known as excitation in speech coders). Prominent examples are unvoiced speech, especially strong fricatives and affricatives like "s" or the German "z", as well as certain percussive sounds primarily in modern music. In embodiments according to the present invention, the guided bandwidth extension is thus only activated for such "unpredictable" high-frequency spectra.

A minimally guided bandwidth extension according to the present invention was implemented in the context of LD-USAC, a low-delay version of xHE-AAC, to extend the wideband-coded (WB-coded) signal bandwidth at 13.2 kbits/s from 6.4 to 8.0 kHz. On the encoder side, the blind/guided decision is computed per codec frame of 20 ms from the spectral tilt of the input signal on a perceptual frequency scale (an existing feature also used in the ACELP-coding path) as well as time-domain features like the change in zero-crossing rate of the input signal provided by an existing transient detector (which is also utilized for other coding mode decisions). More specifically, if the spectral tilt is positive, meaning the spectral energy tends to increase with increasing frequency, and above a specified threshold, and at the same time the zero-crossing rate has increased by a certain ratio or is above a certain threshold, meaning the current frame represents the start of or lies within a noisy waveform passage, then the guided bandwidth extension is chosen and signaled. Otherwise, the blind bandwidth extension is selected. Regarding the aforementioned thresholds, a simple hysteresis is further applied in order to reduce the probability of switching back and forth between guided and blind bandwidth extension. Once the guided bandwidth extension mode is adopted for a frame, the decision thresholds to be used in succeeding frames are lowered a bit so that the codec is more likely to remain in the guided mode. Once it has been decided to switch back to the blind mode, the original thresholds are reinstated, making it less likely for the bandwidth extension decision to toggle back to guided mode right away.

The remainder of the per-frame bandwidth extension procedure is summarized as follows:

1. If the bandwidth extension is in blind mode, transmit a "0" using one bit in the bitstream to signal this mode to the decoder. Optionally, do not transmit any bit and let the decoder identify the frame as using the blind bandwidth extension mode by a decoder-side analysis of the core signal.
2. If the bandwidth extension is in guided mode, transmit a "1" using one bit in the bitstream. Then the encoder computes four frequency gain indices, each covering 400 Hz of the input signal, to allow for accurate spectral shaping of the 6.4 to 8 kHz bandwidth extension region in the decoder. In a low-delay USAC realization, each of the four indices is the result of a scalar quantization of one of the four bandwidth extension region QMF energies relative to the preceding QMF energy (or to the energy of the 4.8-6.4 kHz QMF spectrum, in case of the first bandwidth extension gain). Since a 2-bit mid-rise quantizer with a step-size of 2 dB is employed, the gains cover a value range of −3 . . . 3 dB and consume 8 bit per frame. This yields a total side-information of 9 bit per guided bandwidth extension frame or, optionally, 8 bit if excluding the signaling as in step 1.
3. In the corresponding decoder, the first bandwidth extension bit is read. If it is "0", blind bandwidth extension is used, otherwise 8 more bits are read and the guided bandwidth extension is used. Optionally, reading of the first bandwidth extension bit is skipped (as this bit is not present in the bitstream), and the blind/guided decision is performed locally by core-signal analysis, as mentioned in step 1.
4. If the blind bandwidth extension mode was determined in the decoder, a bandwidth extension using only features of the decoded core signal is performed. This bandwidth extension essentially follows the bandwidth extension concept described in one of references [2], [3], [6] and [9] but in the QMF instead of the DFT domain and with only low-complexity features derived from the core QMF spectrum, e.g. spectral centroid/tilt.
5. If the guided bandwidth extension mode was selected in the decoder, the four 2-bit gain indices are inverse quantized into QMF energy gains and applied for spectral shaping of the QMF bandwidth extension region bands which are reconstructed as in step 4. In other words, a blind bandwidth extension is employed here as well, except that the spectral shaping is done via scale factors transmitted in the bitstream, instead of via scaling extrapolated from the core signal (which, as a result, constitutes a parameter-guided bandwidth extension).
6. When switching between blind and guided bandwidth extension from one frame to the next, a simple smoothing of the high-frequency energies is performed to minimize switching artifacts (high-frequency energy discontinuities) caused by the lowpass-like behavior of the blind bandwidth extension. The smoothing essentially works as a cross-fader between the blind and guided bandwidth extensions: a first guided bandwidth extension frame following some blind bandwidth extension frame(s) is damped a bit in its high-frequency region, while the high-frequency damping of a first blind bandwidth extension frame after some guided bandwidth extension(s) is reduced a bit.

On typical telephonic speech content and popular music, experiments have shown that about 13% of all 20 ms frames are utilizing the guided bandwidth extension in LD-USAC. The average bandwidth extension side-information rate therefore amounts to roughly 2 bit per frame or 0.1 kbit/s. This is much less than the rates of (e)SBR (cf., for example, reference [8]) or any of the guided speech-coder bandwidth extensions referenced herein.

It shall further be noted that, as suggested as optional method in the step-by-step description earlier in this section, the 1-bit signaling of the bandwidth extension mode decision to the decoder can be avoided if both encoder and decoder can derive that decision from the core-coded signal in a bit-exact fashion. This can be achieved if the encoder selects the bandwidth extension mode based on some features derived from the locally decoded core signal, since this is the only signal available in the decoder. Assuming that no transmission error occurred in a certain frame and both encoder and decoder determine the bandwidth extension mode from exactly the same core-signal features (such as quantized LPC coefficients or time-domain statistics from the decoded residual signal like the zero-crossing rate, as noted above), the mode decision is identical in encoder and decoder.

Embodiments according to the invention overcome a certain quality dilemma in wideband codecs which can be observed at bitrates of 9-13 kbit/s. It has been found that, on the one hand, such rates are already too low to justify the transmission of even moderate amounts of bandwidth extension data, ruling out typical guided bandwidth extension systems with 1 kbit/s or more of side-information. On the other hand, it has been found that a feasible blind bandwidth extension is found to sound significantly worse on at least some types of speech or music material due to the inability of proper parameter prediction from the core signal. It has been found that it is therefore desirable to reduce the side-information rate of a guided bandwidth extension scheme to a level far below 1 kbit/s, which allows its adoption even in very-low-bitrate coding. The approach, which is used in embodiments according to the invention, is to identify segments of typical input signals which are badly or sub-optimally reconstructed by blind bandwidth extension, and to transmit only for these segments the side-information necessitated to improve the high-frequency reconstruction quality to an acceptable level (or at least a level which is in the range of the average blind bandwidth extension quality on that signal). In other words: parts of the high-frequency input signal which are recreated reasonably well by a blind bandwidth extension should be coded with very little or no bandwidth extension side-information, and only passages on which a blind bandwidth extension would degrade the overall impression of the codec quality should have their high-frequency components reproduced by a guided bandwidth extension. Such a bandwidth extension design, which adjusts the side-information rate in a signal-adaptive fashion, is the subject of the present invention and is termed "minimally guided bandwidth extension".

Embodiments according to the invention outperform multiple bandwidth extension approaches which have been documented in recent years (cf., for example, references [1], [2], [3], [4], [5], [6], [7], [8], [9] and [10]). In general, all of these are either fully blind or fully guided in a given operating point, regardless of the instantaneous characteristics of the input signal. Furthermore, all implementations of blind bandwidth extensions (cf., for example, references [1], [3], [4], [5], [9] and [10]) are optimized exclusively for speech signals and as such are unlikely to yield satisfactory quality on other input such as music (which is even noted in some publications). Finally, most of the conventional bandwidth extension realizations are relatively complex, employing Fourier transforms, LPC filter computations, or vector quantization of the side-information. This can cause a disadvantage in the adoption of new coding technology in mobile telecommunication markets, given that the majority of mobile devices provide very limited computational power.

To further conclude, embodiments according to the invention create an audio encoder or a method for audio encoding or a related computer program as described above.

Further embodiments according to the invention create an audio decoder or method of audio decoding or a related computer program as described above.

Additional embodiments according to the invention create an encoded audio signal or a storage medium having stored the encoded audio signal as described above.

9. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The apparatus described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] B. Bessette et al., "The Adaptive Multi-rate Wideband Speech Codec (AMR-WB)," IEEE Trans. on Speech and Audio Processing, Vol. 10, No. 8, November 2002.

[2] B. Geiser et al., "Bandwidth Extension for Hierarchical Speech and Audio Coding in ITU-T Rec. G.729.1," IEEE Trans. on Audio, Speech, and Language Processing, Vol. 15, No. 8, November 2007.

[3] B. Iser, W. Minker, and G. Schmidt, Bandwidth Extension of Speech Signals, Springer Lecture Notes in Electrical Engineering, Vol. 13, New York, 2008.

[4] M. Jelínek and R. Salami, "Wideband Speech Coding Advances in VMR-WB Standard," IEEE Trans. on Audio, Speech, and Language Processing, Vol. 15, No. 4, May 2007.

[5] I. Katsir, I. Cohen, and D. Malah, "Speech Bandwidth Extension Based on Speech Phonetic Content and Speaker Vocal Tract Shape Estimation," in Proc. EUSIPCO 2011, Barcelona, Spain, September 2011.

[6] E. Larsen and R. M. Aarts, Audio Bandwidth Extension: Application of Psycho-acoustics, Signal Processing and Loudspeaker Design, Wiley, New York, 2004.

[7] J. Mäkinen et al., "AMR-WB+: A New Audio Coding Standard for 3rd Generation Mobile Audio Services," in Proc. ICASSP 2005, Philadelphia, USA, March 2005.

[8] M. Neuendorf et al., "MPEG Unified Speech and Audio Coding—The ISO/MPEG Standard for High-Efficiency Audio Coding of All Content Types," in Proc. 132nd AES Convention, Budapest, Hungary, April 2012. Also appears in the Journal of the AES, 2013.

[9] H. Pulakka and P. Alku, "Bandwidth Extension of Telephone Speech Using a Neural Network and a Filter Bank Implementation for Highband Mel Spectrum," IEEE Trans. on Audio, Speech, and Language Processing, Vol. 19, No. 7, September 2011.

[10] T. Vaillancourt et al., "ITU-T EV-VBR: A Robust 8-32 kbit/s Scalable Coder for Error Prone Telecommunications Channels," in Proc. EUSIPCO 2008, Lausanne, Switzerland, August 2008.

[11] L. Miao et al., "G.711.1 Annex D and G.722 Annex B: New ITU-T Superwideband codecs," in Proc. ICASSP 2011, Prague, Czech Republic, May 2011.

The invention claimed is:

1. An audio encoder for providing an encoded audio information on the basis of an input audio information, the audio encoder comprising:

a low frequency encoder configured to encode a low frequency portion of the input audio information to acquire an encoded representation of the low frequency portion; and a bandwidth extension information provider configured to provide bandwidth extension information on the basis of the input audio information;

wherein the audio encoder is configured to selectively include bandwidth extension information into the encoded audio information in a signal-adaptive manner;

wherein the audio encoder comprises a detector configured to identify portions of the input audio information for which bandwidth extension parameters cannot be estimated on the basis of the low frequency portion with a sufficient or desired accuracy; and wherein the audio encoder is configured to selectively include bandwidth extension information into the encoded audio information for portions of the input audio information identified by the detector.

2. The audio encoder according to claim 1, wherein the audio encoder is configured to identify portions of the input audio information which cannot be decoded with a sufficient or desired quality on the basis of the encoded representation of the low-frequency portion, and using a blind bandwidth extension; and wherein the audio encoder is configured to selectively include bandwidth extension information into the encoded audio information for identified portions of the input audio information which cannot be decoded with a sufficient or desired quality on the basis of the encoded representation of the low-frequency portion, and using a blind bandwidth extension.

3. The audio encoder according to claim 1, wherein the audio encoder is configured to identify portions of the input audio information in dependence on whether the portions are temporally stationary portions and in dependence on whether the portions comprise a low-pass character; and wherein the audio encoder is configured to selectively omit an inclusion of bandwidth extension information into the encoded audio information for portions of the input audio information identified as temporally stationary portions comprising a low-pass character.

4. The audio encoder according to claim 3, wherein the audio encoder is configured to identify portions of the input audio information in dependence on whether the portions comprise voiced speech, and/or in dependence on whether the portions comprise environmental noise, and/or in dependence on whether the portions comprise music without percussive instrumentation.

5. The audio encoder according to claim 1, wherein the audio encoder is configured to identify portions of the input audio information in dependence on whether a difference between a spectral envelope of a low frequency portion and a spectral envelope of a high frequency portion is larger than or equal to a predetermined difference measure; and wherein the audio encoder is configured to selectively include bandwidth extension information into the encoded audio information for portions of the input audio information identified in dependence on whether a difference between a spectral envelope of a low frequency portion and a spectral envelope of a high frequency portion is larger than or equal to a predetermined difference measure.

6. The audio encoder according to claim 5, wherein the audio encoder is configured to identify portions in dependence on whether the portions comprise unvoiced speech, and/or wherein the audio encoder is configured to identify portions in dependence on whether the portions comprise percussive sounds.

7. The audio encoder according to claim 1, wherein the audio encoder is configured to determine a spectral tilt of portions of the input audio information, and to identify portions of the input audio information in dependence on whether the determined spectral tilt is larger than or equal to a fixed or variable tilt threshold value; and wherein the audio encoder is configured to selectively include bandwidth extension information into the encoded audio information for portions of the input audio information identified in dependence on whether the determined spectral tilt is larger than or equal to a fixed or variable tilt threshold.

8. The audio encoder according to claim 7, wherein the audio encoder is further configured to determine a zero crossing rate of portions of the input audio information, and to identify portions of the input audio information also in dependence on whether the determined zero crossing rate is larger than or equal to a fixed or variable zero crossing rate threshold value or in dependence on whether the zero crossing rate comprises a temporal change which exceeds a zero crossing rate change threshold value.

9. The audio encoder according to claim 2, wherein the audio encoder is configured to apply a hysteresis for identifying signal portions of the input audio information, to reduce a number of transitions between identified signal portions and not-identified signal portions.

10. The audio encoder according to claim 1, wherein the audio encoder is configured to selectively include parameters representing a spectral envelope of a high frequency portion of the input audio information into the encoded audio information in a signal-adaptive manner as the bandwidth extension information.

11. The audio encoder according to claim 1, wherein the low frequency encoder is configured to encode a low frequency portion of the input audio information, comprising frequencies up to a maximum frequency which lies in a range between 6 and 7 kHz, and wherein the audio encoder is configured to selectively include into the encoded audio representation between three and five parameters describing intensities of high frequency signal portions comprising bandwidths between 300 Hz and 500 Hz.

12. The audio encoder according to claim 11, wherein the audio encoder is configured to selectively include into the encoded audio representation 4 scalar quantized parameters describing intensities of four high frequency signal portions, the high frequency signal portions covering frequency ranges above the low frequency portion.

13. The audio encoder according to claim 11, wherein the audio encoder is configured to selectively include into the encoded audio representation a plurality of parameters describing a relationship between energies or intensities of spectrally adjacent frequency portions, wherein one of the parameters describes a ratio or difference between an energy or intensity of a first bandwidth extension high frequency portion and a low frequency portion, and wherein other of the parameters describe ratios or differences between energies or intensities of other bandwidth extension high frequency portions.

14. An audio decoder for providing a decoded audio information on the basis of an encoded audio information, the audio decoder comprising:

a low frequency decoder configured to decode an encoded representation of a low frequency portion to acquire a decoded representation of the low frequency portion; and a bandwidth extension configured to acquire a bandwidth extension signal using a blind bandwidth extension for portions of an audio content for which no bandwidth extension parameters are included in the encoded audio information, and to acquire the bandwidth extension signal using a parameter-guided bandwidth extension for portions of the audio content for which bandwidth extension parameters are included in the encoded audio information;

wherein the audio decoder is configured to decide whether to use a blind bandwidth extension or a parameter-guided bandwidth extension on the basis of the encoded representation of the low frequency portion without evaluating a bandwidth extension mode signaling flag.

15. The audio decoder according to claim 14, wherein the audio decoder is configured to decide whether to acquire the bandwidth extension signal using a blind bandwidth extension or using a parameter-guided bandwidth extension on a frame-by-frame basis.

16. The audio decoder according to claim 14, wherein the audio decoder is configured to switch between a usage of a blind bandwidth extension and a parameter-guided bandwidth extension within a contiguous piece of audio content.

17. The audio decoder according to claim 14, wherein the audio decoder is configured to evaluate flags included in the encoded audio information for different portions of the audio content, to decide whether to use a blind bandwidth extension or a parameter-guided bandwidth extension.

18. The audio decoder according to claim 14, wherein the audio decoder is configured to decide whether to use a blind bandwidth extension or a parameter-guided bandwidth extension on the basis of one or more features of the decoded representation of the low frequency portion.

19. The audio decoder according to claim 14, wherein the audio decoder is configured to decide whether to use a blind bandwidth extension or a parameter-guided bandwidth extension on the basis of linear prediction coefficients and/or on the basis of time domain statistics of the decoded representation of the low frequency portion.

20. The audio decoder according to claim 14, wherein the bandwidth extension is configured to acquire the bandwidth extension signal using one or more features of the decoded representation of the low frequency portion and/or using one or more parameters of the low frequency decoder for temporal portions of the input audio content for which no bandwidth extension parameters are included in the encoded audio information.

21. The audio decoder according to claim 14, wherein the bandwidth extension is configured to acquire the bandwidth extension signal using a spectral centroid information and/or using an energy information, and/or using a tilt information, and/or using filter coefficients for temporal portions of the input audio content for which no bandwidth extension parameters are included in the encoded audio information.

22. The audio decoder according to claim 14, wherein the bandwidth extension is configured to acquire the bandwidth extension signal using bitstream parameters describing a spectral envelope of a high frequency portion for temporal portions of the audio content for which bandwidth extension parameters are included in the encoded audio information.

23. The audio decoder according to claim 22, wherein the bandwidth extension is configured to evaluate between three and five bitstream parameters describing intensities of high frequency signal portions comprising bandwidths between 300 Hz and 500 Hz, in order to acquire the bandwidth extension signal.

24. The audio decoder according to claim 23, wherein the between three and five bitstream parameters describing intensities of high frequency signal portions, are scalar quantized with 2 or 3 bits resolution, such that there are between 6 and 15 bits of bandwidth extension spectral shaping parameters per audio frame .

25. The audio decoder according to claim 14, wherein the bandwidth extension is configured to perform a smoothing of energies of the bandwidth extension signal when switching from blind bandwidth extension to parameter-guided bandwidth extension and/or when switching from parameter-guided bandwidth extension to blind bandwidth extension.

26. The audio decoder according to claim 25, wherein the bandwidth extension is configured to dampen a high frequency portion of the bandwidth extension signal for a portion of the audio content to which a parameter guided bandwidth extension is applied following a portion of the audio content to which a blind bandwidth extension is applied; and wherein the bandwidth extension is configured to reduce a damping or to increase a level for a high frequency portion of the bandwidth extension signal for a portion of the audio content to which a blind bandwidth extension is applied following a portion of the audio content to which a parameter guided bandwidth extension is applied.

27. A method for providing an encoded audio information on the basis of an input audio information, the method comprising:

encoding a low frequency portion of the input audio information to acquire an encoded representation of the low frequency portion; and providing bandwidth extension information on the basis of the input audio information;

wherein bandwidth extension information is selectively included into the encoded audio information in a signal-adaptive manner;

wherein the method comprises identifying portions of the input audio information for which bandwidth extension parameters cannot be estimated on the basis of the low frequency portion with a sufficient or desired accuracy; and wherein the method comprises selectively including bandwidth extension information into the encoded audio information for identified portions of the input audio information.

28. A method for providing a decoded audio information on the basis of an encoded audio information, the method comprising:

decoding an encoded representation of a low frequency portion to acquire a decoded representation of the low frequency portion; and acquiring a bandwidth extension signal using a blind bandwidth extension for portions of an audio content for which no bandwidth extension parameters are included in the encoded audio information, and acquiring the bandwidth extension signal using a parameter-guided bandwidth extension for portions of the audio content for which bandwidth extension parameters are included in the encoded audio information;

wherein the method comprises deciding whether to use a blind bandwidth extension or a parameter-guided bandwidth extension on the basis of the encoded representation of the low frequency portion without evaluating a bandwidth extension mode signaling flag.

29. A non-transitory storage medium having stored thereon a computer program for performing the method according to claim 27 when the computer program runs on a computer.

30. A non-transitory storage medium having stored thereon a computer program for performing the method according to claim 28 when the computer program runs on a computer.

31. An audio encoder for providing an encoded audio information on the basis of an input audio information, the audio encoder comprising:

a low frequency encoder configured to encode a low frequency portion of the input audio information to acquire an encoded representation of the low frequency portion; and a bandwidth extension information provider configured to provide bandwidth extension information on the basis of the input audio information;

wherein the audio encoder is configured to selectively include bandwidth extension information into the encoded audio information in a signal-adaptive manner;

wherein the audio encoder comprises a detector configured to identify portions of the input audio information in dependence on whether a difference between a spectral envelope of a low frequency portion and a spectral envelope of a high frequency portion is larger than or equal to a predetermined difference measure; and wherein the audio encoder is configured to selectively include bandwidth extension information into the encoded audio information for portions of the input audio information identified by the detector.

32. An audio encoder for providing an encoded audio information on the basis of an input audio information, the audio encoder comprising:

a low frequency encoder configured to encode a low frequency portion of the input audio information to acquire an encoded representation of the low frequency portion; and a bandwidth extension information provider configured to provide bandwidth extension information on the basis of the input audio information;

wherein the audio encoder is configured to selectively include bandwidth extension information into the encoded audio information in a signal-adaptive manner;

wherein the audio encoder comprises a detector configured to determine a spectral tilt of portions of the input audio information, and to identify portions of the input audio information in dependence on whether the determined spectral tilt is larger than or equal to a fixed or variable tilt threshold value; and wherein the audio encoder is configured to selectively include bandwidth extension information into the encoded audio information for portions of the input audio information identified by the detector.

33. An audio decoder for providing a decoded audio information on the basis of an encoded audio information, the audio decoder comprising:

a low frequency decoder configured to decode an encoded representation of a low frequency portion to acquire a decoded representation of the low frequency portion; and a bandwidth extension configured to acquire a bandwidth extension signal using a blind bandwidth extension for portions of an audio content for which no bandwidth extension parameters are included in the encoded audio information, and to acquire the bandwidth extension signal using a parameter-guided bandwidth extension for portions of the audio content for which bandwidth extension parameters are included in the encoded audio information;

wherein the bandwidth extension is configured to perform a smoothing of energies of the bandwidth extension signal when switching from blind bandwidth extension to parameter-guided bandwidth extension and/or when switching from parameter-guided bandwidth extension to blind bandwidth extension;

wherein the bandwidth extension is configured to dampen a high frequency portion of the bandwidth extension signal for a portion of the audio content to which a parameter guided bandwidth extension is applied following a portion of the audio content to which a blind bandwidth extension is applied; and wherein the bandwidth extension is configured to reduce a damping or to increase a level for a high frequency portion of the bandwidth extension signal for a portion of the audio content to which a blind bandwidth extension is applied following a portion of the audio content to which a parameter guided bandwidth extension is applied.

34. A method for providing an encoded audio information on the basis of an input audio information, the method comprising:

encoding a low frequency portion of the input audio information to acquire an encoded representation of the low frequency portion; and providing bandwidth extension information on the basis of the input audio information;

wherein bandwidth extension information is selectively included into the encoded audio information in a signal-adaptive manner;

wherein the method comprises identifying portions of the input audio information in dependence on whether a difference between a spectral envelope of a low frequency portion and a spectral envelope of a high frequency portion is larger than or equal to a predetermined difference measure; and wherein the method comprises selectively including bandwidth extension information into the encoded audio information for identified portions of the input audio information.

35. A method for providing an encoded audio information on the basis of an input audio information, the method comprising:

encoding a low frequency portion of the input audio information to acquire an encoded representation of the low frequency portion; and providing bandwidth extension information on the basis of the input audio information;

wherein bandwidth extension information is selectively included into the encoded audio information in a signal-adaptive manner;

wherein the method comprises determining a spectral tilt of portions of the input audio information, and identifying portions of the input audio information in dependence on whether the determined spectral tilt is larger than or equal to a fixed or variable tilt threshold value; and wherein the method comprises selectively including bandwidth extension information into the encoded audio information for identified portions of the input audio information.

36. A method for providing a decoded audio information on the basis of an encoded audio information, the method comprising:

decoding an encoded representation of a low frequency portion to acquire a decoded representation of the low frequency portion; and acquiring a bandwidth extension signal using a blind bandwidth extension for portions of an audio content for which no bandwidth extension parameters are included in the encoded audio information, and acquiring the bandwidth extension signal using a parameter-guided bandwidth extension for portions of the audio content for which bandwidth extension parameters are included in the encoded audio information;

wherein the method comprises performing a smoothing of energies of the bandwidth extension signal when switching from blind bandwidth extension to parameter-guided bandwidth extension and/or when switching from parameter-guided bandwidth extension to blind bandwidth extension;

wherein the method comprises dampening a high frequency portion of the bandwidth extension signal for a portion of the audio content to which a parameter guided bandwidth extension is applied following a portion of the audio content to which a blind bandwidth extension is applied; and wherein the method comprises reducing a damping or increasing a level for a high frequency portion of the bandwidth extension signal for a portion of the audio content to which a blind bandwidth extension is applied following a portion of the audio content to which a parameter guided bandwidth extension is applied.

37. A non-transitory storage medium having stored thereon a computer program for performing the method according to claim 34 when the computer program runs on a computer.

38. A non-transitory storage medium haying stored thereon a computer program for performing the method according to claim 35 when the computer program runs on a computer.

39. A non-transitory storage medium haying stored thereon a computer program for performing the method according to claim 36 when the computer program runs on a computer.

* * * * *